US007357494B2

(12) United States Patent
Katayama et al.

(10) Patent No.: US 7,357,494 B2
(45) Date of Patent: Apr. 15, 2008

(54) INK CARTRIDGE AND INK-JET PRINTER

(75) Inventors: Naoki Katayama, Kariya (JP); Toyonori Sasaki, Anjo (JP); Tomohiro Kanbe, Bisai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 514 days.

(21) Appl. No.: 10/938,840

(22) Filed: Sep. 13, 2004

(65) Prior Publication Data

US 2005/0068389 A1 Mar. 31, 2005

(30) Foreign Application Priority Data

| | | |
|---|---|---|
| Sep. 30, 2003 | (JP) | 2003-340284 |
| Mar. 16, 2004 | (JP) | 2004-074508 |
| Mar. 17, 2004 | (JP) | 2004-076627 |
| Mar. 17, 2004 | (JP) | 2004-076628 |

(51) Int. Cl.
*B41J 2/175* (2006.01)

(52) U.S. Cl. ..... 347/86

(58) Field of Classification Search ..... 347/7, 347/85–87

See application file for complete search history.

(56) References Cited

U.S. PATENT DOCUMENTS

| | | | |
|---|---|---|---|
| 5,719,609 | A | 2/1998 | Hauck et al. |
| 5,736,992 | A | 4/1998 | Pawlowski, Jr. |
| 5,777,647 | A | 7/1998 | Pawlowski, Jr. et al. |
| 6,116,723 | A | 9/2000 | Childers |
| 6,422,674 | B1 | 7/2002 | Hinami et al. |
| 6,521,311 | B2 | 2/2003 | Ito et al. |
| 7,178,911 | B2 | 2/2007 | Katayama et al. |

FOREIGN PATENT DOCUMENTS

| | | |
|---|---|---|
| EP | 0 405 555 A2 | 1/1991 |
| EP | 0 660 092 A1 | 6/1995 |
| EP | 1 142 713 A2 | 10/2001 |
| EP | 1 281 526 A1 | 2/2003 |
| JP | A-59-192573 | 10/1984 |
| JP | A-63-207652 | 8/1988 |
| JP | A 9-1819 | 1/1997 |
| JP | 2005-297320 | 10/2005 |

*Primary Examiner*—An H. Do
(74) *Attorney, Agent, or Firm*—Oliff & Berridge, PLC

(57) ABSTRACT

An ink cartridge has an ink tank in which the ink is stored, and a shutter mechanism which is arranged in the ink tank. The shutter mechanism includes a lever which is supported swingably and which has one end provided with a shutter and the other end provided with a float. The mass and the volume of the float are set so that the first direction, in which the lever moves by the buoyancy and the gravity generated when the entire shutter mechanism is positioned in the ink, is opposite to the second direction in which the lever moves by the buoyancy and the gravity when a part of the float protrudes from the ink liquid surface. A residual amount of an ink is indicated without being excessively affected by any disturbance such as the surface tension of the ink.

28 Claims, 21 Drawing Sheets

INK CARTRIDGE AND INK-JET PRINTER

BACKGROUND OF THE INVENTION

1. Field of the Invention

The present invention relates to an ink cartridge which supplies an ink to an ink-jet head for performing printing by discharging the ink, and an ink-jet printer including the same.

2. Description of the Related Art

An ink-jet printer is known, in which an ink is discharged from nozzles to recording paper to perform the printing. Such an ink-jet printer is generally provided with a detachable ink cartridge. When an ink-jet head is driven to perform the discharge operation in a state in which the ink is empty in the ink cartridge, then the printing is not only performed, but the air sometimes makes invasion into the ink-jet head. The ink-jet head, into which the air has made invasion, cannot be used in some cases. Therefore, it is necessary to detect the amount of the ink stored in the ink cartridge. A method for detecting the amount of the ink is conceived, in which the amount of the ink is detected by estimating and accumulating the amounts of the ink used every time when the printing is performed. However, any error tends to arise in such calculation. Therefore, it is necessary to stop the use of the ink cartridge with a sufficient margin. As a result, the ink is wasted. Accordingly, the following technique has been suggested (see, for example, Japanese Patent Application Laid-open No. 9-001819, FIG. 7). That is, a float, which has a specific gravity smaller than that of the ink, is arranged on the ink contained in the ink cartridge. The height of the float floating on the ink is detected from the outside to detect the amount of the ink contained in the ink cartridge.

However, according to the technique suggested by Japanese Patent Application Laid-open No. 9-001819, the float is sometimes stuck to the wall surface, and the float is not moved downwardly due to any disturbance such as the surface tension of the ink adhered to the inner wall surface of the ink tank of the ink cartridge. As described above, the technique suggested by Japanese Patent Application Laid-open No. 9-001819 tends to suffer from the influence of the disturbance such as the surface tension of the ink. Therefore, a problem arises such that it is impossible to indicate any correct amount of the ink contained in the ink cartridge.

SUMMARY OF THE INVENTION

Accordingly, a principal object of the present invention is to provide an ink cartridge which makes it possible to indicate the amount of the ink contained in the ink cartridge without being excessively effected by the disturbance such as the surface tension of the ink, and an ink-jet printer which includes the same.

According to a first aspect of the present invention, there is provided an ink cartridge comprising an ink tank (11, 201) which stores an ink (200); and a swinging member (32, 203) which is supported swingably in the ink tank (11, 201) and which has a balance member (33, 202) supported to be positioned in an ink liquid when an amount of the ink in the ink tank (11, 201) is not less than a predetermined amount; wherein a weight and a volume of the balance member (33, 202) are set so that a rotational force (204), which is received by the swinging member (32, 203) by a buoyancy and a gravity generated on the balance member (33, 202) when the balance member (33, 202) is positioned in the ink liquid, is in a first direction that is opposite to a second direction of a rotational force (205) which is received by the swinging member by a buoyancy and a gravity generated on the balance member (33, 202) when a part of the balance member (33, 202) protrudes from a liquid surface of the ink.

FIG. 24 shows an example of the ink cartridge of the present invention. FIG. 24 conceptually shows the arrangement and the operation of the ink cartridge of the present invention. The ink cartridge of the present invention includes a balance member 202 which is supported to make no contact with the wall surface of an ink tank 201, for example, by the aid of any support member 203 in the ink tank 201 in which an ink 200 is stored.

As shown in FIG. 24A, in the ink cartridge of the present invention, when the ink 200 remains in an amount not less than a predetermined amount in the ink tank 201, the buoyancy, which acts on the balance member 202, is larger than the gravity. Therefore, the rotational force (arrow 204 shown in FIG. 24A, rotational force in the first direction) acts in the direction directed toward the liquid surface of the ink 200. However, the balance member 202 is supported so that the balance member 202 does not float on the liquid surface of the ink 200, i.e., the balance member 202 stays in the ink tank 200. When the ink 200 is used, and the amount of the ink contained in the ink tank 201 is decreased to be smaller than the predetermined amount (specifically, when the ink is decreased until a part of the balance member 202 protrudes from the ink liquid surface), then the buoyancy, which acts on the balance member 202, is decreased. Therefore, the gravity, which acts on the balance member 202, is larger than the buoyancy. Therefore, as shown in FIG. 24B, the rotational force (arrow 205 shown in FIG. 24B, rotational force in the second direction), which is directed toward the bottom surface of the ink tank 201, acts on the balance member 202. The balance member 202 is moved toward the bottom surface of the ink tank 201.

The residual amount of the ink contained in the ink cartridge can be detected by detecting the displacement of the balance member 202 as shown in FIG. 24 by using, for example, a sensor. In the case of the ink cartridge as described above, the balance member 202 is supported to make no contact with the wall surface in the ink tank. Further, the displacement orbit of the balance member 202 can be fixed to some extent. Therefore, it is possible to prevent the balance member 202 from being stuck to the wall surface of the ink tank due to any disturbance such as the surface tension of the ink adhered to the inner wall surface of the ink tank 201 when the ink is decreased. It is possible to indicate the amount of the ink in the ink cartridge more correctly.

In the ink cartridge of the present invention, the swinging member (80) may include a connecting member (32A) which is supported swingably in the ink tank (11, 201), a detection objective section (34A) which is provided at one end of the connecting member (32A), and the balance member (33A) which is provided at the other end of the connecting member (32A); and weights and volumes of the balance member (33A) and the detection objective section (34A) may be set so that the rotational force, which is received by the swinging member (80) by buoyancies and gravities generated on the balance member (33A) and the detection objective section (34A) respectively when the entire balance member (33A) and the entire detection objective section (34A) are positioned in the ink liquid, is in the first direction that is opposite to the second direction of the rotational force which is received by the swinging member (80) by buoyancies and gravities generated on the balance member (33A) and the detection objective section (34A)

respectively when parts of the balance member (33A) and the detection objective section (34A) protrude from the liquid surface of the ink.

According to the ink cartridge of the present invention, the orbits of the balance member and the detection objective section are fixed by the swinging member. Therefore, the state of the residual amount of the ink contained in the ink tank can be indicated without being excessively affected by the disturbance such as the surface tension of the ink adhered, for example, to the inner wall surface of the ink tank when the ink is decreased.

In the ink cartridge of the present invention, a regulating member (35A), which regulates rotation of the swinging member (80) in the first direction, may be provided in the ink tank (11), and the detection objective section (34A) may be positioned at a detecting position when the swinging member (80) is regulated by the regulating member (35A). Accordingly, when the ink in an amount not less than a predetermined amount is stored in the ink tank, it is possible to reliably stop the detection objective section at the detecting position.

In the ink cartridge of the present invention, the balance member (33A) may be positioned at a position lower than that of the detection objective section (34A) when the detection objective section (34A) is positioned at the detecting position. Accordingly, when the ink contained in the ink tank is decreased, the detection objective section protrudes from the ink liquid surface prior to the balance member. Therefore, the swinging member starts the rotation in the second direction after the ink adhered to the detection objective section flows down. Therefore, it is possible to reduce the influence of the surface tension of the ink on the detection objective section when the swinging member starts the rotation in the second direction.

In the ink cartridge of the present invention, the detection objective section (34A) may be positioned at a non-detecting position when the swinging member (80) is rotated in the second direction. Accordingly, it is possible to distinguish and recognize the state in which the amount of ink is decreased as compared with the predetermined amount and the state in which the ink remains in an amount of not less than the predetermined amount.

In the ink cartridge of the present invention, the rotational force in the first direction may have a magnitude which is substantially the same as that of the rotational force in the second direction. Accordingly, the rotational forces to cause the rotation in the first direction and the second direction can be exerted on the swinging member in a well-balanced manner. Therefore, it is possible to indicate the state of the residual amount of the ink in the ink tank without being excessively affected by not only the surface tension of the ink but also the disturbance caused, for example, by the increase in viscosity of the ink.

In the ink cartridge of the present invention, the connecting member (32A) may be supported in the ink tank (11) so that a width of a projection plane obtained by perpendicularly projecting the connecting member (32A) onto the ink liquid surface is narrowest in a state of use of the ink cartridge (1A). Accordingly, it is possible to decrease the contact area between the connecting member and the ink liquid surface when the connecting member protrudes from the ink liquid surface. Therefore, it is possible to reduce the influence of the surface tension of the ink on the connecting member.

In the ink cartridge of the present invention, the connecting member (32A) may be supported in the ink tank (11) so that a side wall surface of the connecting member (32A), which is opposed to the ink liquid surface, intersects obliquely with respect to the ink liquid surface. Accordingly, it is possible to further decrease the contact area between the connecting member and the ink liquid surface when the connecting member protrudes from the ink liquid surface. Therefore, it is possible to further reduce the influence of the surface tension of the ink on the connecting member.

In the ink cartridge of the present invention, at least one projection (32*a*A), which protrudes toward the ink liquid surface and which extends in an extending direction of the connecting member (32A), may be formed on the side wall surface of the connecting member (32A) opposed to the ink liquid surface. Accordingly, it is possible to further decrease the contact area between the connecting member and the ink liquid surface when the connecting member protrudes from the ink liquid surface. Therefore, it is possible to further reduce the influence of the surface tension of the ink on the connecting member.

In the ink cartridge of the present invention, the balance member (33A) may be a float which is formed of a resin and which has a specific gravity smaller than that of the light-transmissive ink. Accordingly, it is possible to increase the ratio of the buoyancy generated on the balance member with respect to the gravity generated on the balance member. Therefore, it is possible to obtain the sufficiently large rotational force in the first direction.

In the ink cartridge of the present invention, the balance member (33A) may be formed of polypropylene. Accordingly, the specific gravity of polypropylene is 0.9, and the specific gravity is generally lighter than that of the light-transmissive ink. Therefore, when polypropylene is used as the balance member, it is possible to increase the buoyancy generated on the balance member.

In the ink cartridge of the present invention, the balance member (33A) may have a tightly closed space (36A) therein. Accordingly, even when any resin having a specific gravity larger than that of the ink is used, it is possible to decrease the specific gravity of the entire balance member. Further, it is possible to form the balance member and the swinging member with an identical material.

When the balance member has the tightly closed space therein, the balance member (33A) may be provided with a case (33*a*A) and a cap (33*b*A) which are integrally formed, the cap (33*b*A) may be arranged at an opening of the case (33*a*A), and an internal space of the case (33*a*A) may be tightly sealed to form the tightly closed space (36A). Accordingly, it is possible to produce the swinging member easily and cheaply.

In the ink cartridge of the present invention, a volume ratio K of the tightly closed space (36A) with respect to a volume of the balance member (33A) may be represented by the following expression:

$$(2X-Y)/2X-0.1<K<(2X-Y)/2X+0.1$$

wherein X represents the specific gravity of the resin, and Y represents the specific gravity of the light-transmissive ink. Accordingly, it is possible to determine the rotational forces in the first direction and the second direction exerted on the swinging member in a well-balanced manner.

In the ink cartridge of the present invention, a volume ratio K of the tightly closed space (36A) with respect to a volume of the balance member (33A) may be not less than 0.3 and not more than 0.5. The preferred range of the ratio K is a preferred range to be obtained when a preferred resin having a specific gravity of 0.9 is used as a material for forming the balance member, and a preferred ink having a specific gravity of 1.07 is used. When the volume ratio K of the tightly close space with respect to the volume of the balance member is set within the range as described above, it is possible to determine the rotational forces in the first direction and the second direction exerted on the swinging member in a well-balanced manner.

In the ink cartridge of the present invention, the detection objective section (34A) may have nontransparency. Accordingly, an optical sensor can be used as a detector for detecting the displacement of the detection objective section.

In the ink cartridge of the present invention, the detection objective section (34A) may be provided on the connecting member (32A) so that a width of a projection plane obtained by perpendicularly projecting the detection objective section (34A) onto the ink liquid surface is narrowest in a state of use of the ink cartridge (1A). Accordingly, it is possible to decrease the contact area between the detection objective section and the ink liquid surface when the detection objective section protrudes from the liquid surface of the ink. Therefore, the influence of the surface tension of the ink is further decreased, and hence it is possible to rotate the swinging member more smoothly.

In the ink cartridge of the present invention, the ink cartridge (103) may further include a regulating surface (156) which regulates displacement of the swinging member; the ink tank (131) may have a downwardly inclined inner surface (134*b*) which extends in a direction inclined downwardly with respect to the ink surface; the swinging member may be formed with an abutment section (160*a*) which is capable of being selectively located at a position to make abutment against the regulating surface (156) and a position separated from the regulating surface (156) depending on a position of the swinging member; and a projection (159), which is always opposed to the downwardly inclined inner surface (134*b*) during movement of the abutment section (160*a*) between the separated position and the abutment position, may be formed at a portion of the swinging member opposed to the downwardly inclined inner surface (134*b*).

According to the ink cartridge of the present invention, the distance between the swinging member and the downwardly inclined inner surface is maintained by the projection formed at the portion of the swinging member opposed to the downwardly inclined inner surface. Therefore, it is possible to avoid the adhesion between the swinging member and the downwardly inclined inner surface opposed thereto due to the surface tension of the ink, and the inhibition of the smooth displacement action of the swinging member. Therefore, the swinging member is smoothly moved as the residual amount of the ink is changed, and hence it is possible to detect, with any small error, the fact that the ink residual amount in the ink tank arrives at a predetermined amount.

In the ink cartridge of the present invention, the ink tank (131) may be formed with a recess (134*a*) which has two of the downwardly inclined inner surfaces (134*b*) opposed to each other and which is defined by the two opposed downwardly inclined inner surfaces (134*a*); at least a part of the swinging member may be interposed between the two downwardly inclined inner surfaces (134*b*) opposed in the recess (134*a*); and the projection (159) may protrude toward each of the downwardly inclined inner surfaces (134*b*) from a portion of the swinging member opposed to one of the two downwardly inclined inner surfaces (134*b*). Accordingly, it is possible to narrow the width of the recess by shortening the distance between the swinging member and the downwardly inclined inner surface of the recess formed in the ink tank. Therefore, it is easy to detect the displacement of the swinging member from the outside of the recess.

In the ink cartridge of the present invention, the swinging member may be formed with a thin plate-shaped section (160) which is interposed between the two downwardly inclined inner surfaces (134*b*) opposed in the recess (134*a*) when the abutment section (160*a*) is located at the abutment position, and the projection (159) may protrude from the thin plate-shaped section (160). Accordingly, it is possible to further narrow the width of the recess formed for the ink tank.

In the ink cartridge of the present invention, a rib (158) may protrude toward the swinging member from each of portions of the two downwardly inclined inner surfaces (134*b*) opposed to the swinging member. Accordingly, the ink, which remains between the downwardly inclined inner surface and the swinging member, falls downwardly along the rib. Therefore, it is possible to further avoid the adhesion between the downwardly inclined inner surface and the swinging member caused by the surface tension of the ink.

In the ink cartridge of the present invention, the rib (158) may be provided continuously along a displacement orbit of the swinging member. Accordingly, the ink, which remains between the downwardly inclined inner surface and the swinging member, successfully falls downwardly more efficiently.

In the ink cartridge of the present invention, the tip portion of the recess (159) may be constructed by a curved surface which protrudes toward the downwardly inclined inner surface (134*b*). In this arrangement, the projection of the swinging member and the downwardly inclined inner surface make point-to-point contact with each other, and the contact area between the projection of the swinging member and the downwardly inclined inner surface is decreased. Therefore, the swinging member is hardly affected by the surface tension of the ink, and it is possible to smoothly displace the swinging member.

In the ink cartridge of the present invention, the abutment section (160*a*) may be a columnar projection which extends along the ink surface, and a wall (157) may be provided adjacently in an upstanding manner, which intersects the regulating surface (156) in the extending direction of the abutment section (160*a*) when the abutment section (160*a*) makes abutment against at least the regulating surface (156). Accordingly, the abutment section of the swinging member and the regulating surface make line-to-line contact with each other, and the contact area between the abutment section and the regulating surface is decreased. Therefore, the abutment section and the regulating surface are hardly adhered to each other by the surface tension of the ink. When the wall, which intersects the regulating surface, is provided in the upstanding manner on the regulating surface, the ink, which is stored or pooled on the regulating surface, is sucked and removed by the capillary force of the curved portion formed at the boundary between the regulating surface and the wall surface. Therefore, it is possible to further avoid the adhesion by the surface tension of the ink between the abutment section and the regulating surface.

In the ink cartridge of the present invention, the regulating surface (156) may be an inclined surface which intersects the ink surface. Therefore, the ink, which is pooled on the regulating surface, flows downwardly along the inclination of the regulating surface. Thus, the ink is more hardly pooled on the regulating surface.

Additionally, in the ink cartridge of the present invention, the swinging member may be rotatable in the ink tank (131)

about the center of an axis perpendicular to the direction of displacement of the ink surface as the ink is used, depending on the increase/decrease in the amount of the ink stored in the ink tank (131). Accordingly, when the swinging member is rotated, the orbit of the swinging member is stabilized. Therefore, the downwardly inclined inner surface and the swinging member are hardly adhered to one another by the surface tension of the ink.

In the ink cartridge of the present invention, the projection (159) and the downwardly inclined inner surface (134*b*) opposed thereto may be formed in the vicinity of the end of the swinging member. Accordingly, the adhesion of the swinging member to the downwardly inclined inner surface, which would be otherwise caused by the surface tension of the ink, can be reliably avoided.

In the ink cartridge of the present invention, the projection (159B) and the downwardly inclined inner surface (134*b*) opposed thereto may be formed in the vicinity of the axis of the swinging member. When the projection is formed in the vicinity of the rotation axis of the swinging member, it is possible to narrow the range of displacement of the projection when the swinging member is rotated. It is possible to decrease the downwardly inclined inner surface opposed to the projection of the swinging member.

Additionally, in the ink cartridge of the present invention, the ink tank (131) may have a regulating surface (156) which is substantially perpendicular to a direction of displacement of the ink surface caused by use of the ink, and a downwardly inclined inner surface (134*b*) which extends in a direction inclined downwardly with respect to the regulating surface from one end of the regulating surface (156); the swinging member may be formed with an abutment section (160*a*) which is selectively located at a position to make abutment against the regulating surface (156) and a position separated from the regulating surface (156) depending on a position of the swinging member; a recess (134*a*), which is defined by two of the downwardly inclined inner surfaces (134*b*) opposed to each other, may be formed on an inner wall surface of the ink tank (131); at least a part of the swinging member may be interposed between the two downwardly inclined inner surfaces (134*b*) opposed in the recess; a projection (159), which is always opposed to each of the downwardly inclined inner surfaces (134*b*) during movement of the abutment section (160*a*) between the separated position and the abutment position, may protrude toward each of the downwardly inclined inner surfaces (134*b*) from each of portions of the swinging member opposed to the downwardly inclined inner surfaces (134*b*); and a rib (158) may protrude toward the swinging member from each of portions of the two downwardly inclined inner surfaces (134*b*) opposed to the swinging member.

In the ink cartridge of the present invention, the ink tank (131) may have a regulating surface (156) which regulates displacement of the swinging member, and a wall surface (169) which extends downwardly toward the ink liquid surface from one end of the regulating surface (156); the swinging member may be formed with an abutment section (160*a*) which is selectively located at a position to make abutment against the regulating surface (156) and a position separated from the regulating surface depending on a position of the swinging member; and a rib (157), which ranges over the regulating surface (156) and the wall surface (169), may protrude from each of the regulating surface (156) and the wall surface (169).

When the arrangement as described above is adopted, the ink, which remains on the regulating surface of the ink tank, falls downwardly along the rib. Therefore, the abutment section of the swinging member and the regulating surface of the ink tank are hardly adhered to one another by the surface tension of the ink. Therefore, when the swinging member is rotated in accordance with the change of the ink residual amount, the swinging member is smoothly rotated. It is possible to detect, with any small error, the fact that the ink residual amount in the ink cartridge arrives at a predetermined amount.

In the ink cartridge of the present invention, the rib (157), which is disposed on a side opposed to the abutment section (160*a*), may have a side surface which is inclined in an outer direction as compared with a direction perpendicular to the regulating surface (156) and the wall surface (169) or the perpendicular direction on condition that the position of abutment between the abutment section (160*a*) and the regulating surface (156) is on an inner side. Accordingly, the suction force (hereinafter referred to as "capillary force" as well), which is caused by the capillary action at the boundary between the regulating surface and the rib, is decreased. Therefore, the ink is hardly stored or pooled at the boundary.

In the ink cartridge of the present invention, the rib (157) may be provided continuously over a range from one end to the other end of the regulating surface (156). Accordingly, the ink, which remains on the regulating surface, tends to fall downwardly along the rib.

In the ink cartridge of the present invention, the rib (157) may be provided continuously over a range from an upper end to a lower end of the wall surface (169). Accordingly, the ink, which remains on the downwardly inclined inner surface, tends to fall downwardly along the rib.

In the ink cartridge of the present invention, that a curve, which ranges over the rib (157) and the regulating surface (156) in the vicinity of the boundary between the rib (157) and the regulating surface (156), may have a curvature which is smaller than a curvature of a curve which ranges over the rib (157) and the wall surface (169) in the vicinity of the boundary between the rib (157) and the wall surface (169). Accordingly, the capillary force, which is obtained at the boundary between the rib and the wall surface, is larger than the capillary force which is obtained at the boundary between the rib and the regulating surface. Therefore, the ink, which remains at the boundary between the regulating surface and the rib, tends to fall downwardly along the rib.

In the ink cartridge of the present invention, the regulating surface (156) may be an inclined surface which intersects the ink surface. Accordingly, the ink, which remains on the regulating surface, tends to fall downwardly more easily.

In the ink cartridge of the present invention, the ink tank (131) may have a downwardly inclined inner surface (134*b*) which extends in a direction inclined downwardly with respect to a surface perpendicular to a direction of displacement of the ink surface caused by use of the ink; and a rib (158) may protrude toward the swinging member from a portion of the downwardly inclined inner surface (134*b*) opposed to the swinging member.

When the arrangement as described above is adopted, the ink, which remains on the downwardly inclined inner surface of the ink tank opposed to the swinging member, tends to fall downwardly along the rib. Therefore, the swinging member and the downwardly inclined inner surface opposed to the swinging member are hardly adhered to one another by the surface tension of the ink. Accordingly, the swinging member is rotated smoothly when the swinging member is rotated in accordance with the change of the residual amount of the ink. It is possible to detect, with any small error, the fact that the ink residual amount in the ink cartridge is substantially zero.

In the ink cartridge of the present invention, the rib (158) may be provided continuously along a displacement orbit of the swinging member. Accordingly, it is possible to efficiently discharge the ink stored or pooled between the swinging member and the downwardly inclined inner surface opposed thereto.

In the ink cartridge of the present invention, a recess (134*a*), in which the two downwardly inclined inner surfaces (134*b*) are opposed to each other, may be formed on the inner wall of the ink tank (131), at least a part of the swinging member may be interposed between the two downwardly inclined inner surfaces (134*b*) opposed in the recess (134*a*), and the rib (158) may protrude toward the swinging member from the two downwardly inclined inner surfaces (134*b*) respectively. Accordingly, it is possible to shorten the distance between the swinging member and the downwardly inclined inner surface of the recess formed in the ink tank. Therefore, it is easy to detect the displacement of the swinging member from the outside of the recess.

In the ink cartridge of the present invention, a curve, which ranges over the rib (158) and the downwardly inclined inner surface (134*b*) in the vicinity of the boundary between the rib (158) and the upper end of the downwardly inclined inner surface (134*b*), may have a curvature which is smaller than a curvature of a curve which ranges over the rib (158) and the downwardly inclined inner surface (134*b*) in the vicinity of the boundary between the rib (158) and the lower end of the downwardly inclined inner surface (134*b*). Accordingly, the capillary force, which is obtained at the boundary between the lower end of the rib and the downwardly inclined inner surface opposed to the swinging member, is larger than the capillary force which is obtained at the boundary between the upper end of the rib and the downwardly inclined inner surface opposed to the swinging member. Therefore, the ink, which remains at the boundary between the rib and the downwardly inclined inner surface opposed to the swinging member, tends to fall downwardly along the rib.

In the ink cartridge of the present invention, the swinging member may have a thin plate-shaped section (160) which is opposed to the two downwardly inclined inner surfaces (134*b*) to form the recess (134*a*). Accordingly, it is possible to further shorten the distance between the swinging member and the downwardly inclined inner surface of the recess formed in the ink tank. Therefore, it is easier to detect the displacement of the swinging member from the outside of the recess.

In the ink cartridge of the present invention, the swinging member may be rotatable in the ink tank (131) about the center of an axis perpendicular to the direction of displacement of the ink surface as the ink is used, depending on the increase/decrease in the amount of the ink stored in the ink tank (131). Accordingly, when the swinging member is rotated, the orbit of the swinging member is stabilized. Therefore, the swinging member and the downwardly inclined inner surface opposed thereto are hardly adhered to one another by the surface tension of the ink.

In the ink cartridge of the present invention, the ink tank (131) may have a regulating surface (156) which is substantially perpendicular to a direction of displacement of the ink surface caused by use of the ink, and a wall surface (169) and a downwardly inclined inner surface (134*b*) which downwardly extend toward the regulating surface (156) from respective ends of the regulating surface (156); the swinging member may be formed with a columnar abutment section (160*a*) which extends in a direction perpendicular to the direction of displacement and which is located at a position to make abutment against the regulating surface (156) and a position separated therefrom depending on a position of the swinging member; a first rib (157) may protrude from the regulating surface (156) and the wall surface (169), the first rib (157) ranging over both of the wall surface (169) and the regulating surface (156) and being disposed adjacently to the abutment section (160*a*) when the abutment section (160*a*) is at the abutment position; a recess (134*a*), which is defined by a pair of the downwardly inclined inner surfaces (134*b*) opposed to each other, may be formed on an inner wall of the ink tank (131); and at least a part of the swinging member may be interposed between the downwardly inclined inner surfaces (134*b*) opposed in the recess (134*a*), and a second rib (158) may protrude toward the swinging member from each of portions of the downwardly inclined inner surfaces (134*b*) opposed to the swinging member.

According to a second aspect of the present invention, there is provided an ink-jet printer comprising an installation section (70) to which the ink cartridge according to the first aspect is installed to perform recording on a medium with an ink supplied from the ink cartridge (1) installed to the installation section (70); wherein a detector (21), which detects a detection objective section (34) of the ink cartridge (1) installed to the installation section (70), is provided at a position at which the detection objective section (34) positioned at a detecting position is detectable.

According to the ink-jet printer of the present invention, the orbits of rotation of the balance member and the detection objective section are fixed when the swinging member is rotated. Therefore, it is possible to correctly detect the amount of the ink with the detector without being excessively affected by the disturbance caused, for example, by the surface tension of the ink.

In the ink-jet printer of the present invention, ink-jet printer may further comprise a judging unit (62) which judges states of the ink cartridge (1) and the ink-jet printer (60) according to a result of detection obtained by the detector (21); wherein a judgment is made by the judging unit (62) on a state in which a sufficient amount of the ink is charged to the ink cartridge (1) installed to the installation section (70) if the detector (21) detects the detection objective section (34), while a judgment is made on any one of a state in which the ink contained in the ink cartridge (1) installed to the installation section (70) is decreased and a state in which the ink cartridge (1) is not installed to the installation section (70) if the detector (21) does not detect the detection objective section (34). Accordingly, it is possible to judge, with one detector, the state of the residual amount of the ink in the ink cartridge and the presence or the absence of the installation of the ink cartridge.

In the ink-jet printer of the present invention, the detector (21) may be a light-transmissive type sensor. Accordingly, it is possible to use the cheap light-transmissive type sensor. Therefore, it is possible to realize the low cost of the ink-jet printer.

According to a third aspect of the present invention, there is provided an ink cartridge comprising an ink tank (11, 201) in which an ink is stored; a float (33, 202) which floats on the ink; a support member (32, 203) which swingably supports the float so that the float makes no contact with an inner surface of the ink tank; a detection objective section (34A) which is provided on the support member (32, 203) or the float; and a regulating member (35A) which regulates the support member so that the float is positioned in the ink when an amount of the ink contained in the ink tank is not less than a predetermined amount. In the case of this ink cartridge, when a predetermined amount of the ink exists in the ink tank, the float is retained in the ink by the aid of the regulating member. When the ink is less than the predetermined amount, then the float floats on the ink surface, and the float also makes swinging movement as the ink surface is lowered. Therefore, it is possible to detect the residual amount of the ink by the aid of the detection objective section provided on the support member or the float. In the case of this ink cartridge, the support member swingably supports the float without any contact of the float with the inner surface of the ink tank. Therefore, the float is not restricted by the inner surface of the tank by the surface tension of the ink. When the ink is not less than the predetermined amount, the float is retained in the ink. Therefore, the float is not affected by the surface tension of the ink. In order to allow the swinging movement of the float to follow the residual amount of the ink more correctly, it is appropriate that the buoyancy and the gravity of the float are adjusted or controlled as in the first aspect of the present invention.

BRIEF DESCRIPTION OF THE DRAWINGS

FIG. 12 shows an ink cartridge depicted in FIG. 11, wherein

FIG. 19 shows sectional views illustrating an ink supply valve depicted in FIG. 14, wherein

FIG. 24 schematically shows an example of the ink cartridge of the present invention, wherein

DESCRIPTION OF THE PREFERRED EMBODIMENTS

First Embodiment

A first embodiment according to the present invention will be explained with reference to the drawings.

Figure 1:
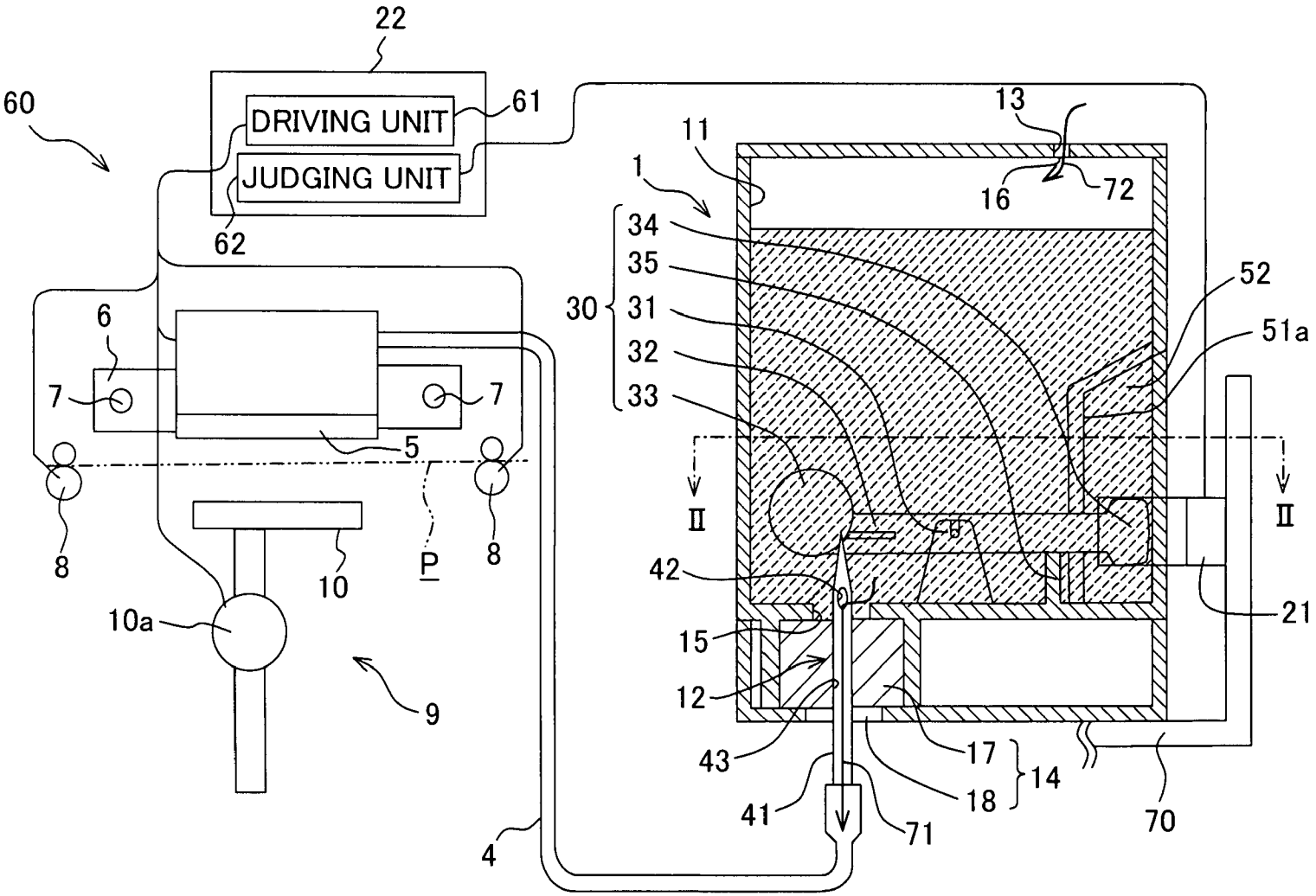
FIG. 1 shows a schematic illustration illustrating an ink-jet printer including an ink cartridge according to a first embodiment.
Figure 2:
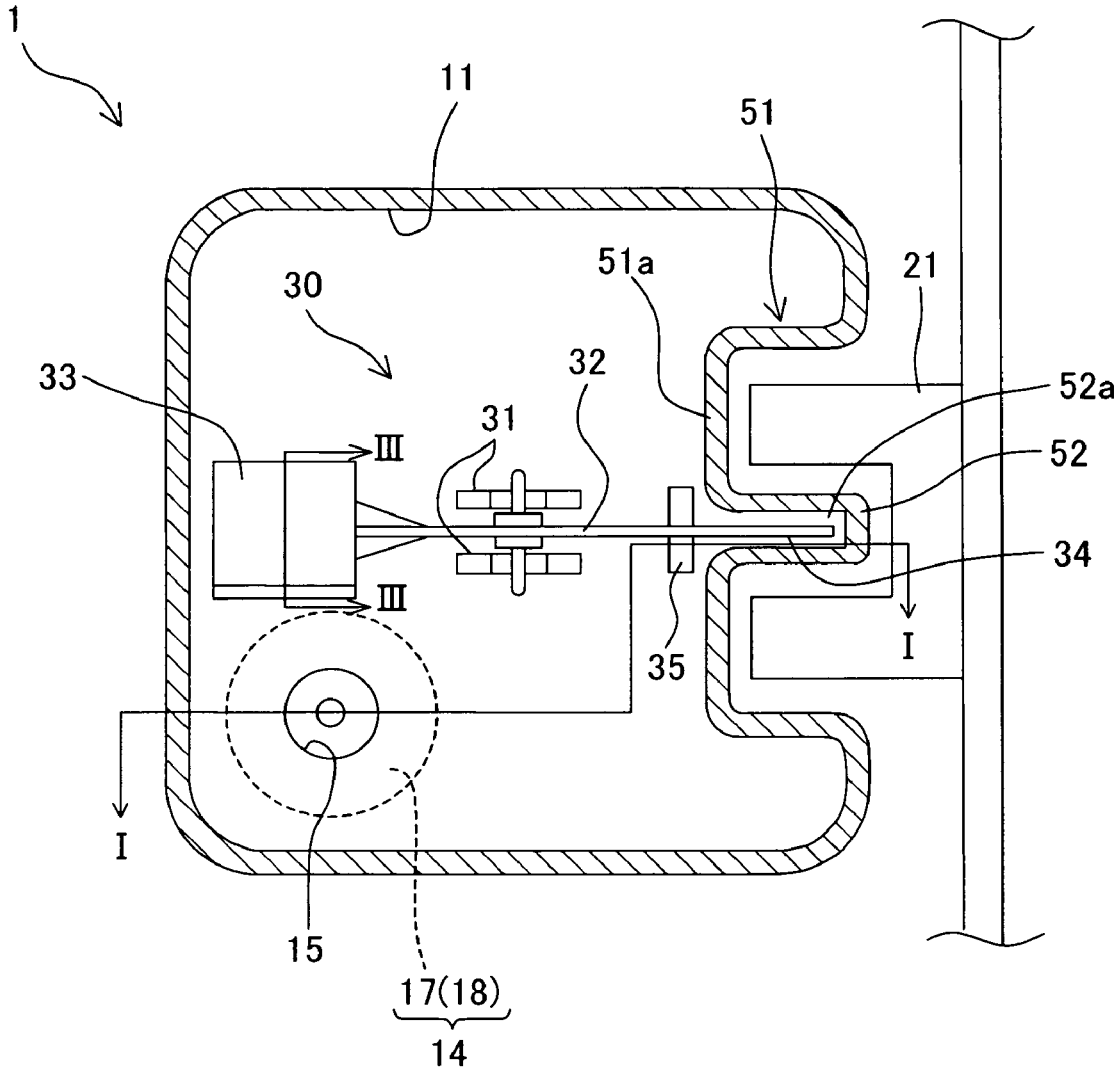
FIG. 2 shows a sectional view taken along a line II-II shown in FIG. 1 illustrating the ink cartridge depicted in FIG. 1.
Figure 3:
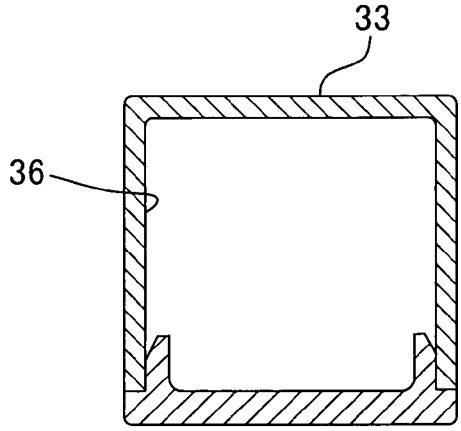
FIG. 3 shows a sectional view taken along a line III-III shown in FIG. 2 illustrating a float depicted in FIG. 2.

FIG. 1 shows a partial schematic view illustrating an ink-jet printer including an ink cartridge according to the first embodiment. The ink cartridge 1 shown in FIG. 1 illustrates a cross-sectional structure of the ink cartridge 1 as being cut along a line I-I shown in FIG. 2. An arrow 71 shown in FIG. 1 indicates the flow of the ink, and an arrow 72 indicates the flow of the atmospheric air. FIG. 2 shows a sectional view illustrating the ink cartridge 1 taken along a line II-II shown in FIG. 1. FIG. 3 shows a sectional view illustrating a float 33 taken along a line III-III shown in FIG. 2.

As shown in FIG. 1, the ink-jet printer 60 includes an ink-jet head 5 which discharges the light-transmissive ink toward the recording paper P, an ink cartridge 1 which stores the ink (I in the drawing) to be discharged to the ink-jet head 5, a carriage 6 which linearly reciprocates and moves the ink-jet head 5 in a certain direction (direction perpendicular to the surface of paper) along a guide 7, a transport mechanism 8 which transports the recording paper P in a direction perpendicular to the direction of movement of the ink-jet head 5 in parallel to the ink discharge surface of the ink-jet head 5, a purge unit 9 which sucks the air contained in the ink-jet head 5 and the ink having any high viscosity, a sensor (detector) 21 which detects the amount of the ink contained in the ink cartridge 1 and the presence or absence of the ink cartridge 1, and a control unit 22 which controls the above.

The ink-jet head 5 has the ink discharge surface on which a large number of nozzles (not shown) for discharging the ink are formed. The ink-jet head 5 is controlled by the control unit 22 so that the ink supplied from an ink supply tube 4 is discharged from the respective nozzles. As shown in FIG. 1, the ink supply tube 4 has one end which is connected to the ink-jet head 5 and the other end which is connected to an ink supply pipe 41. As shown in FIG. 1, the ink supply pipe 41 is a tube or pipe having a tapering shape to be connected to the ink cartridge 1. A plurality of ink inflow ports 42 are formed at portions of a sealed tip so that the ink inflow ports 42 are disposed in the circumferential direction on the outer wall. An intra-tubular ink flow passage 43 is communicated with the outside through the ink inflow ports 42.

The ink cartridge 1 is a substantially rectangular parallelepiped-shaped case formed of a light-transmissive synthetic resin. As shown in FIG. 1, the ink cartridge 1 includes an ink tank 11 which stores the ink (I in the drawing), an ink outflow passage 12 which is provided penetratingly through a packing 17 as described later on for allowing the ink stored in the ink tank 11 to outflow to the outside of the ink cartridge 1, an atmospheric air inflow passage 13 which allows the atmospheric air to flow into the ink tank 11, a joint 14 which connects the ink tank 11 and the ink supply pipe 41 and which retains the ink supply pipe 41 in the ink outflow passage 12, and a shutter mechanism (including a swinging member) 30. The ink cartridge 1 is detachably installed to an installation section 70 of the ink-jet printer 60.

As shown in FIG. 1, the ink tank 11 is an ink-storing chamber which is defined by the inner wall of the ink cartridge 1. The ink tank 11 includes an ink outflow port 15 which allows the ink stored in the ink tank 11 to outflow to the ink outflow passage 12, and an atmospheric air inflow port 16 which allows the atmospheric air to flow (arrow 72 shown in FIG. 1) as the ink outflows from the ink outflow port 15. As shown in FIG. 1, the ink cartridge 1 of the first embodiment has the ink outflow port 15 which is provided at the bottom surface of the ink tank 11. The atmospheric air inflow port 16 is provided at the upper surface of the ink tank 11. The ink tank 11 is communicated with the ink outflow passage 12 through the ink outflow port 15. Further, the ink tank 11 is communicated with the atmospheric air inflow passage 13 through the atmospheric air inflow port 16.

As shown in FIG. 2, projections 51, which protrude toward the inside of the ink tank 11 and which extend from the bottom surface of the ink tank 11 to positions in the vicinity of the center in the height direction of the ink tank 11, are formed on one inner side wall of the ink tank 11. As shown in FIG. 2, a recess 52, which is concave as viewed from the inside of the ink tank 11 and which extends in the height direction of the ink tank 11, is formed in the vicinity of the center of bottom walls 51*a* of the projections 51. The recess 52 has an inner space 52*a* which is communicated with the inside of the ink tank 11 and in which the ink may exist.

As shown in FIG. 1, the ink outflow passage 12 is formed at a lower portion the ink tank 11. The ink outflow passage 12 is communicated with the ink tank 11 through the ink outflow port 15. As shown in FIG. 1, the atmospheric air inflow passage 13 is formed at an upper portion of the ink tank 11. The atmospheric air inflow passage 13 is communicated with the ink tank 11 through the atmospheric air inflow port 16, and it is communicated with the outside of the ink tank 11 via an inflow port disposed on a side opposite to the atmospheric air inflow port 16. In a state in which the ink cartridge 1 is not used, the inflow port disposed on the side opposite to the atmospheric air inflow port 16 of the atmospheric air inflow passage 13 is sealed so that the atmospheric air does not flow into the ink tank 11 through the atmospheric air inflow passage 13.

The joint 14 connects the ink tank 11 and the ink supply pipe 41. The joint 14 includes a packing 17 which is arranged in the space comparted by the inner wall of the ink cartridge 1, and an insertion hole 18 which is formed under the packing 17. The packing 17 is formed of an elastic member composed of a flexible resin. The ink outflow passage 12 is formed in the packing 17. When the ink supply pipe 41 is not inserted into the packing 17, the ink outflow passage 12 is sealed by the elastic force of the packing 17. The insertion hole 18 is a circular hole which is formed through the bottom surface of the ink cartridge 1. The insertion hole 18 serves as an insertion port for the ink supply pipe 41 when the ink tank 11 is connected to the ink supply pipe 41.

The procedure for connecting the ink tank 11 and the ink supply pipe 41 is as follows. At first, the ink supply pipe 41 is inserted into the insertion hole 18 of the joint 14. Subsequently, the ink supply pipe 41 is further pressed against the packing 17 at the point of time at which the tip of the ink supply pipe 41 inserted into the insertion hole 18 arrives at the packing 17, and the packing 17 is pierced by the ink supply pipe 41 with the tip having the tapering needle shape. Subsequently, the ink supply pipe 41 is further pressed against the packing 17, and the ink supply pipe 41 is penetrated through the ink outflow passage 12 formed for the packing 17. Finally, the ink supply pipe 41 is further pressed until the ink inflow port 42, which is formed at the tip of the ink supply pipe 41, arrives at the inside of the ink tank 11. Thus, the connection is completed between the ink tank 11 and the ink supply pipe 41. Accordingly, the ink, which is stored in the ink tank 11, flows through the ink inflow port 42 into the intra-tubular ink flow passage 43 of the ink supply pipe 41 (arrow 71 shown in FIG. 1).

The shutter mechanism 30 is driven on the basis of the amount of the ink stored in the ink tank 11. The shutter mechanism 30 is arranged at the bottom of the ink tank 11. As shown in FIG. 1, the shutter mechanism 30 includes a support stand 31, a lever (connecting member) 32, a float (balance member) 33 which is arranged at one end of the lever 32, a shutter (detection objective section) 34 which is arranged at the other end of the lever 32, and a regulating member 35. In the first embodiment, the swinging member is constructed by the lever 32, the float 33, and the shutter 34.

As shown in FIGS. 1 and 2, the support stand 31 is constructed by a pair of plate members having trapezoidal side surfaces. The support stand 31 is fixed in the vicinity of the center of the bottom of the ink tank 11. The lever 32 is a member having a thin plate shape extending in a certain direction. As shown in FIG. 1, the lever 32 is supported so that the lever 32 is interposed between the pair of plate members for constructing the support stand 31 at the central portion in the extending direction. As shown in FIG. 1, the lever 32 is supported and arranged so that the extending direction of the lever 32 is perpendicular to the bottom wall 51*a* of the projection 51 of the ink tank 11 when the ink is sufficiently stored in the ink tank 11. Further, the lever 32 is supported on the support stand 31 swingably about the pivot point at which the lever 32 is supported on the support stand 31. The lever 32 is supported on the support stand 31 so that the width of the projection plane of the lever 32 with respect to the liquid surface of the ink is narrowest.

As shown in FIG. 1, the float 33 is formed at the end of the lever 32 on the side opposite to the side of the side wall formed with the recess 52 of the ink tank 11. The float 33 is a member composed of a polyacetal resin having a cylindrical shape. The float 33 has an enormous volume as compared with the shutter 34. As shown in FIG. 3, a tightly closed space 36, which is filled with the air, is formed in the float 33. Accordingly, the specific gravity of the entire float 33 is smaller than the specific gravity of the ink. Therefore, as shown in FIG. 1, when a sufficient amount of the ink is stored in the ink tank 11, and the entire float 33 is positioned in the ink, then the buoyancy, which is generated on the float 33, is increased. However, when the amount of the ink contained in the ink tank 11 is small, and at least a part of the float 33 protrudes from the ink liquid surface, then the buoyancy, which is generated on the float 33, is decreased (see FIG. 5).

Figure 4:
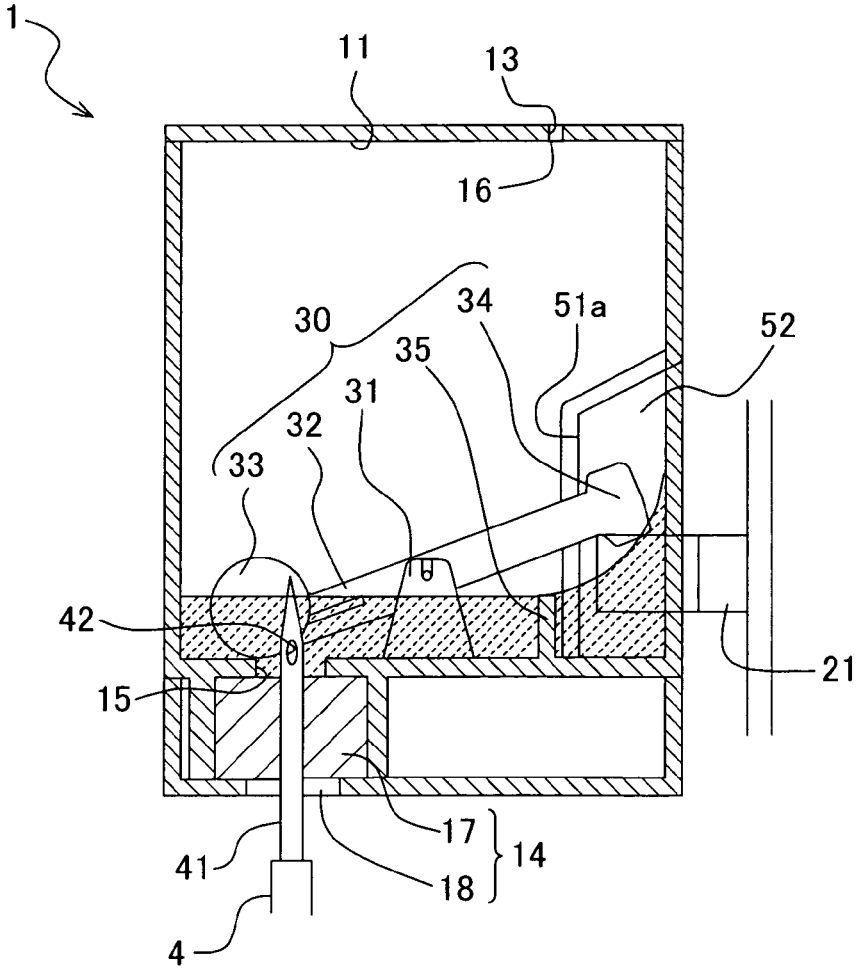
FIG. 4 shows a sectional view illustrating a situation in which the ink amount is small in an ink tank of the ink cartridge depicted in FIG. 1.

As shown in FIG. 1, the shutter 34 is formed at the end of the lever 32 on the side opposite to the side on which the float 33 is arranged. The shutter 34 is a thin plate-shaped member which is nontransparent and substantially rectangular. The shutter 34 is arranged so that the shutter 34 is moved (rotated) in the inner space 52*a* of the recess 52 formed on the side wall of the ink tank 11 as the lever 32 makes the swinging movement. Specifically, as shown in FIG. 1, when a sufficient amount of the ink is stored in the ink tank 11, and the entire float 33 is positioned in the ink, then the float 33 is moved upwardly toward the ink liquid surface, and the lever 32 is rotated in the clockwise direction (first direction) in FIG. 1, because the buoyancy, which acts on the float 33, is larger than the gravity. Accordingly, the shutter 34 is arranged at the detecting position (position opposed to the sensor 21) in the vicinity of the bottom of the recess 52 of the ink tank 11. In this situation, as shown in FIG. 1, the rotational movement of the lever 32 in the first direction is regulated by the regulating member 35 as described later on so that the shutter 34 is not positioned at any position lower than the detecting position. On the other hand, when the amount of the ink contained in the ink tank 11 is decreased, and a part of the float 33 protrudes from the liquid surface of the ink, then the float 33 is moved downwardly toward the bottom surface of the ink tank 11 as shown in FIG. 4, and the lever 32 is rotated in the counterclockwise direction (in the second direction) in FIG. 1, because the gravity, which acts on the float 33, is larger than the buoyancy. Accordingly, as shown in FIG. 4, the shutter 34 is arranged at the non-detecting position (position not opposed to the sensor 21) in the vicinity of the upper portion of the recess 52 of the ink tank 11.

As shown in FIG. 1, the regulating member 35 is a plate-shaped member which is formed to extend upwardly from the bottom of the ink tank 11. The regulating member 35 regulates the rotation of the lever 32 in the certain direction (first direction) so that the shutter 34 is not positioned at any position lower than the detecting position when a sufficient amount of the ink is stored in the ink tank 11, and the entire float 33 is positioned in the ink liquid. Specifically, as shown in FIG. 1, the rotation of the lever 32 in the first direction (clockwise direction in FIG. 1) is regulated, and the shutter 34 is arranged at the detecting position by allowing the upper end of the regulating member 35 to abut against the bottom surface of the lever 32 when the entire float 33 is positioned in the ink liquid.

As shown in FIG. 1, the purge unit 9 includes a purge cap 10 which is installed to the ink discharge surface of the ink-jet head 5, and a suction pump 10*a* which sucks the ink. The purge unit 9 is arranged at the position opposed to the ink-jet head 5 with the recording paper P intervening therebetween. The purge unit 9 is movable in the direction to make approach or separation with respect to the ink discharge surface of the ink-jet head 5. The driving of the suction pump 10*a* is controlled by the control unit 22.

The sensor 21 is a transmissive type optical sensor having a light-emitting section and a light-receiving section which are opposed to one another. As shown in FIG. 2, the sensor 21 is arranged so that the recess 52, which is formed on the side wall of the ink tank 11, is interposed between the light-emitting section and the light-receiving section from the outside of the ink tank 11. In the first embodiment, the residual amount of the ink in the ink tank 11 and the presence or absence of the installation of the ink cartridge 1 are judged by detecting whether or not the light transmission between the light-emitting section and the light-receiving section of the sensor 21 is blocked by the shutter 34 of the shutter mechanism 30. Specifically, the ink and the case of the ink cartridge 1 is light-transmissive, while the shutter 34 of the shutter mechanism 34 is nontransparent. Therefore, when the shutter 34 is arranged at the detecting position (position opposed to the sensor 21) in the vicinity of the bottom in the recess 52 of the ink tank 11 (state as shown in FIG. 1), the light, which is emitted from the light-emitting section of the sensor 21, is blocked by the shutter 34. However, when the shutter 34 is at the non-detecting position (state as shown in FIG. 4), the light, which is emitted from the light-emitting section of the sensor 21, is received by the light-receiving section. That is, the sensor 21 is operated such that the output from the sensor 21 is turned ON/OFF depending on whether or not the light emitted from the light-emitting section is received by the light-receiving section.

The control unit 22 includes CPU (Central Processing Unit) which serves as a computing processing unit, ROM (Read Only Memory) in which programs to be executed by CPU and data to be used for the programs are stored, and RAM (Random Access Memory) which temporarily stores data during the execution of the program. These components are integrated into one unit, and CPU, ROM, and RAM functions as respective functional sections. Accordingly, the ink-jet printer 1 is controlled. The control unit 22 further includes functional sections of a driving unit 61 and a judging unit 62. The driving unit 61 is provided to control the driving of the respective units including, for example, the ink-jet head 5, the carriage 6, and the motor for driving the transport mechanism 8 as well as the suction pump 10*a* of the purge unit 9.

The judging unit 62 judges the presence or absence of the ink cartridge 1 and the state of the amount of the ink contained in the ink tank 11 depending on the detection result of the sensor 21. Specifically, when the shutter 34 is positioned at the detecting position (state as shown in FIG. 1), and the sensor 21 detects the presence of the shutter 34 to output ON, then it is judged that a sufficient amount of the ink is charged into the ink tank 11. When the sensor 21 detects nothing to output OFF, it is judged that any one of the states is given, i.e., the state in which the amount of the ink stored in the ink tank 11 is decreased, and the state in which the ink cartridge 1 is not installed to the installation section 70.

Next, an explanation will be made with reference to FIGS. 1 and 4 about the operation of the shutter mechanism 30. FIG. 4 shows a sectional view of the ink cartridge 1 illustrating a situation in which the ink amount is small in the ink tank 11. On the other hand, FIG. 1 shows a sectional view of the ink cartridge 1 illustrating a situation in which the ink amount is large in the ink tank 11. When the amount of the ink in the ink tank 11 is large as shown in FIG. 1, the entire shutter mechanism 30 is arranged in the ink liquid stored in the ink tank 11. In this situation, the entire lever 32 undergoes the rotational force in the first direction (clockwise direction in FIGS. 1 and 5) by the combined force of the gravity and the buoyancy generated on the float 33 and the gravity and the buoyancy generated on the shutter 34. However, as shown in FIG. 1, the bottom surface portion of the lever 32 abuts against the upper end of the regulating member 35 of the shutter mechanism 30, and thus the rotation of the lever 32 in the first direction is regulated. Specifically, as shown in FIG. 1, the shutter 34 is regulated so that the shutter 34 does not make rotation to any position lower than the detecting position of the sensor 21. Accordingly, when the amount of the ink in the ink tank 11 is large, the shutter 34 is arranged at the detecting position as shown in FIG. 1. When the shutter 34 is arranged at the detecting position in this state, the sensor 21 outputs ON.

On the other hand, as shown in FIG. 4, when the ink amount in the ink tank 11 is decreased as the ink is consumed, the float 33 and the shutter 34 gradually appear on the ink liquid surface. Accordingly, the buoyancies, which are generated on the float 33 and the shutter 34, are gradually decreased, and the influence of the gravities generated on the float 33 and the shutter 34 is increased. In this situation, as for the gravity acting on the entire lever 32, the influence of the gravity acting on the float 33 is increased, because the float 33 is heavy as compared with the shutter 34. When the ink amount is decreased to a predetermined amount, a state is given, in which the buoyancy in the clockwise direction generated on the float 33 is balanced with the gravity in the counterclockwise direction. When the ink is further consumed, the buoyancy, which acts on the float 33, is further decreased. The combined force, which acts on the entire lever 32 as described above, is the rotational force directed in the second direction (counterclockwise direction in FIGS. 4 and 5), and the lever 32 is rotated in the second direction. Accordingly, the lever 32 is separated from the end of the regulating member 35 to move in the direction toward the ink liquid surface, and the shutter 34 is moved to the non-detecting position as shown in FIG. 4. When the residual amount of the ink in the ink tank 11 approaches zero, then the buoyancies, which are generated by the float 33 and the shutter 34, are zero, and the rotational force in the second direction is further increased. When the shutter 34 is arranged at the non-detecting position, the sensor 21 outputs OFF.

Figure 5:
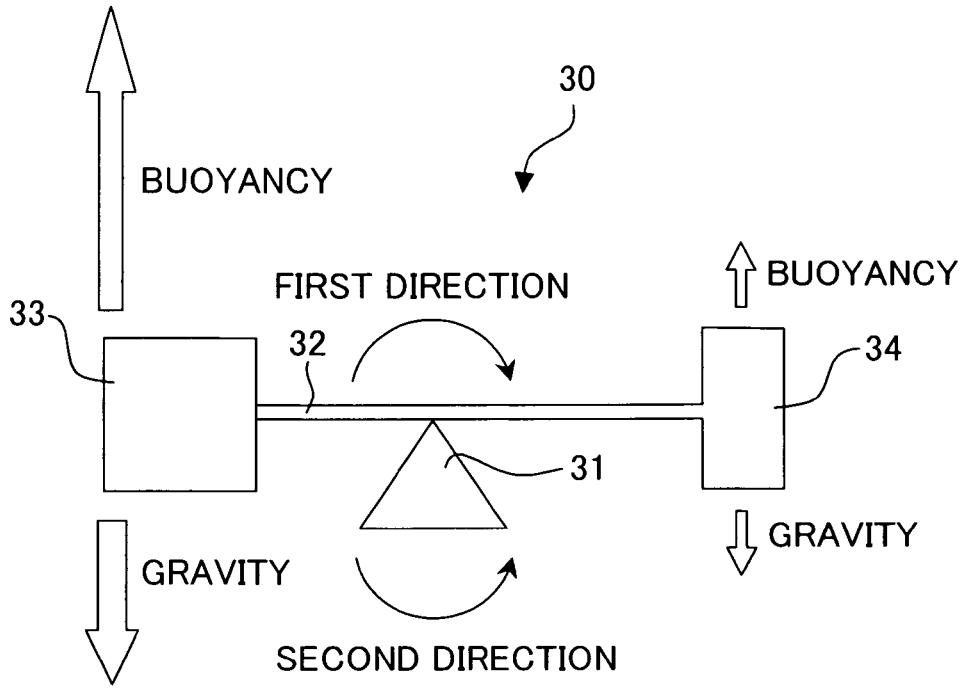
FIG. 5 shows the principle of rotation of a swinging member depicted in FIG. 1.
Figure 6:
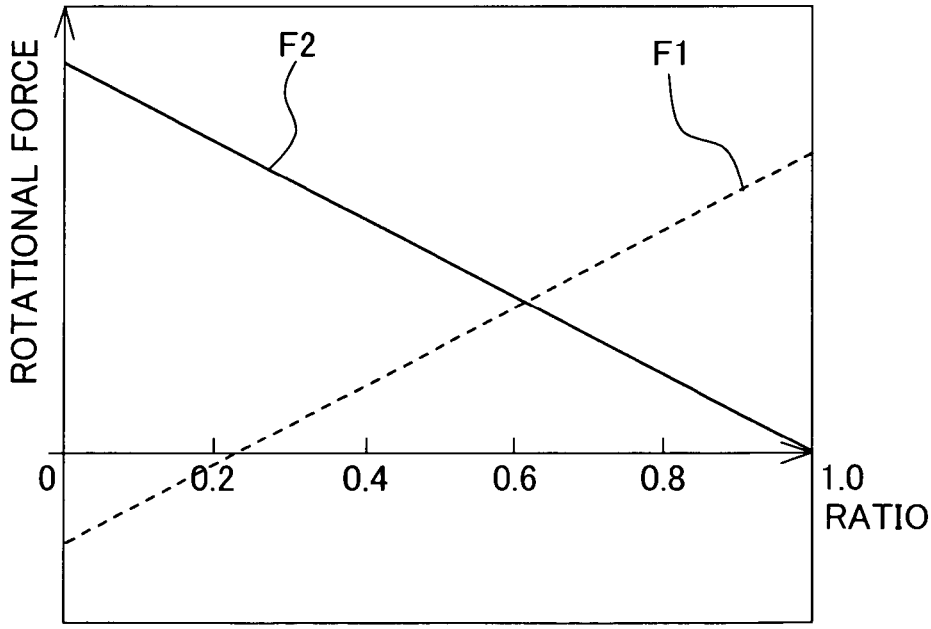
FIG. 6 shows the relationship between the ratio of air in the float depicted in FIG. 1 and the buoyancy and the gravity acting on the float.

Next, an explanation will be made with reference to FIGS. 5 and 6 about details of the principle of rotation of the lever 32. FIG. 5 schematically shows the shutter mechanism 30. FIG. 6 shows the relationship between the volume ratio of the air in the float 33 with respect to the volume of the float 33 and the buoyancy and the gravity acting on the float 33. Actually, as shown in FIG. 5, the direction of rotation of the lever 32 is determined by the combined force of the buoyancies and the gravities acting on the right side portion (on the side of the shutter 34) and the left side portion (on the side of the float 33) with the boundary of the point of support by the support stand 31. However, in order to simplify the explanation, the description will now be made assuming that all of the forces, which are exerted on the shutter mechanism 30, act on the float 33. That is, in this description, the buoyancies and the gravities, which act on the constitutive portions (the shutter 34 and the lever 32) other than the float 33, are neglected. Instead, it is considered that the buoyancies and the gravities, which are received by the entire shutter mechanism 30, act on the float 33. It is assumed that the float 33 has the effective total volume A and the effective volume B of the tightly closed space 36 so that the assumption as described above holds. On this assumption, the rotational forces, which rotate the lever 32 in the first direction and the second direction, are determined by the buoyancy and the gravity acting on the float 33.

When the buoyancy, which acts on the float 33, is extremely larger than the gravity, the rotational force in the first direction is greatly exerted on the float 33. Therefore, when the ink liquid surface is lowered as the ink is consumed, the float 33 tends to undergo the influence such as the surface tension of the ink. In such a case, it is feared that the float 33 does not follow the lowering of the ink liquid surface, and the shutter 34 does not move to the non-detecting position from the detecting position. On the other hand, when the gravity of the float 33 is extremely larger than the buoyancy, the rotational force in the second direction is greatly exerted on the float 33. Therefore, when the ink is consumed and decreased, it is feared that the float 33 arrives at the bottom of the ink tank 11 in a state in which a certain amount of the ink remains in the ink tank 11, and the shutter 34 moves to the non-detecting position.

Therefore, in order to improve the detection accuracy for the residual amount of the ink in the ink tank 11, it is necessary that any one of the rotational forces in the first and second directions acting on the float 33 is not extremely decreased. It is most desirable that the ratio between the effective volume A of the entire float 33 and the effective volume B of the air charged into the tightly closed space 36 of the float 33 is set so that the rotational forces in the first and second directions are approximately identical to one another. The rotational force F1 in the first direction and the rotational force F2 in the second direction acting on the float 33 are expressed as follows:

$$F1=AY-(A-B)X \quad 1$$

$$F2=(A-B)X \quad (2)$$

A: total volume of float 33;

B: volume of air charge into tightly closed space 36 of float 33;

X: specific gravity of float 33;

Y: specific gravity of ink.

Especially, AY corresponds to the combined buoyancy acting on the float 33, and (A−B)X(=F2) corresponds to the combined gravity acting on the float 33. That is, the rotational force F1 in the first direction is expressed as the difference between the combined buoyancy and the combined gravity acting on the float 33. The relationship between the rotational forces F1 and F2 is shown in FIG. 6. The horizontal axis of FIG. 6 represents the volume ratio B/A, the broken line in FIG. 6 represents the change of the rotational force F1 in the first direction acting on the float 33 with respect to the volume ratio B/A, and the solid line in FIG. 6 represents the change of the rotational force F2 in the second direction with respect to the volume ratio B/A. As shown in FIG. 6, as the volume ratio B/A of the closed space 36 with respect to the total volume of the float 33 is larger, the rotational force F1 in the first direction becomes larger. On the other hand, as the volume ratio B/A is smaller, the rotational force F2 in the second direction becomes larger. Assuming that the magnitude of the rotational force in the first direction is the same as that in the second direction, i.e., assuming that F1=F2 is given, the following expression is obtained according to the expression (1) and the expression (2):

$$AY-(A-B)X=(A-B)X \quad (3)$$

Therefore, when F1=F2 is given, the volume ratio B/A=K of the tightly closed space 36 with respect to the total volume of the float 33 is expressed as follows:

$$K=(2X-Y)/2X \quad (4)$$

The polyacetal resin as the material for the float 33 has a specific gravity of 1.41, and the ink has a specific gravity of 1.07. Therefore, the volume ratio K is 0.62 according to the expression (4). Practically, it is desirable that the volume ratio K is determined within the following range:

$$(2X-Y)/2X-0.1<K<(2X-Y)/2X+0.1 \quad (5)$$

In particular, when the specific gravity is 1.41 or a value approximate thereto as in the polyacetal resin as the material for the float 33, it is desirable that the volume ratio K is within a range of not less than 0.5 and not more than 0.7.

In the description of the principle of rotation of the lever 32 described above, the preferred ratio of volume K (=B/A) of the float 33 has been determined while neglecting the buoyancies and the gravities acting on the constitutive portions (shutter 34 and lever 32) other than the float 33. However, when the buoyancies and the gravities acting on the shutter 34 and the lever 32 have significant magnitudes with respect to the buoyancy and the gravity acting on the float 33, it is necessary to determine the preferred volume ratio K (=B/A) while considering the buoyancies and the gravities acting on the shutter 34 and the lever 32.

According to the first embodiment explained above, when the lever 32 is rotated in accordance with the amount of the ink in the ink tank 11, the displacement orbits of the float 33 and the shutter 34 are fixed by the lever 32. Therefore, it is possible to indicate the amount of the ink in the ink tank 11 without being extremely affected by the disturbance caused, for example, by the surface tension of the ink.

According to the first embodiment, even when the rotational force in the first direction acts on the lever 32 when the ink is sufficiently stored in the ink tank 11, it is possible to reliably stop the shutter 34 at the detecting position by the aid of the regulating member 35.

According to the first embodiment, when the amount of the ink is decreased, and the lever 32 is rotated in the second direction, then the shutter 34 is moved to the non-detecting position, and the absence of the shutter 34 at the detecting position is detected by the sensor 21. Therefore, it is possible to detect the situation in which the amount of the ink in the ink tank 11 is decreased to be smaller than the predetermined amount and the situation in which the ink cartridge 1 is not installed to the installation section 70 as the identical situations. That is, it is possible to detect the situation in which the amount of the ink in the ink tank 11 is decreased to be smaller than the predetermined amount and the situation in which the ink cartridge 1 is not installed to the installation section 70 by using the sensor 21. Therefore, in the case of the ink-jet printer according to the first embodiment, it is not only possible to judge the residual amount of the ink in the ink tank 11 but it is also possible to distinguish whether or not another ink cartridge 1 having a large residual amount of the ink is required to be newly installed, by using one sensor 21. Therefore, the cost is decreased.

According to the first embodiment, the float 33 is provided with the tightly closed space 36. Therefore, it is possible to efficiently lower the specific gravity of the entire float 33. In the first embodiment described above, the material, which has the specific gravity larger than that of the ink, is used for the float 33. However, the float 33 may be formed of a material which has a specific gravity smaller than that of the ink, in order to obtain a sufficient rotational force in the first direction.

According to the first embodiment, for example, when the volume ratio K of the tightly closed space 36 with respect to the total volume of the float 33 is 0.62, the rotational force in the first direction acting on the lever 32 has the magnitude which is the same as that of the rotational force in the second direction. Therefore, it is possible to rotate the lever 32 more smoothly without being extremely affected by the disturbance caused, for example, by the increase in viscosity of the ink as well as the surface tension of the ink. It is possible to indicate the amount of the ink in the ink tank 11 more correctly.

Additionally, according to the first embodiment, the shutter 34 has the nontransparency, and the shutter 34 is arranged in the inner space of the narrow-width recess 52 formed in the ink tank 11. Therefore, it is possible to use the light-transmissive type optical sensor which is cheap as the detector. The lever 32, which is provided with the float 33 and the shutter 34, is constructed as the thin plate-shaped member having the small width of the projection plane with respect to the ink liquid surface. Therefore, the surface tension, which is received by the lever 32 from the ink, is decreased. Therefore, it is possible to displace the shutter 34 while correctly following the decrease in the ink.

Second Embodiment

Next, a second embodiment according to the present invention will be explained with reference to the drawings. In the second embodiment, only the shutter mechanism differs from that in the first embodiment. Therefore, in the drawings concerning the second embodiment, the same members as those of the first embodiment are designated by the same reference numerals, any explanation of which will be omitted.

Figure 7B:
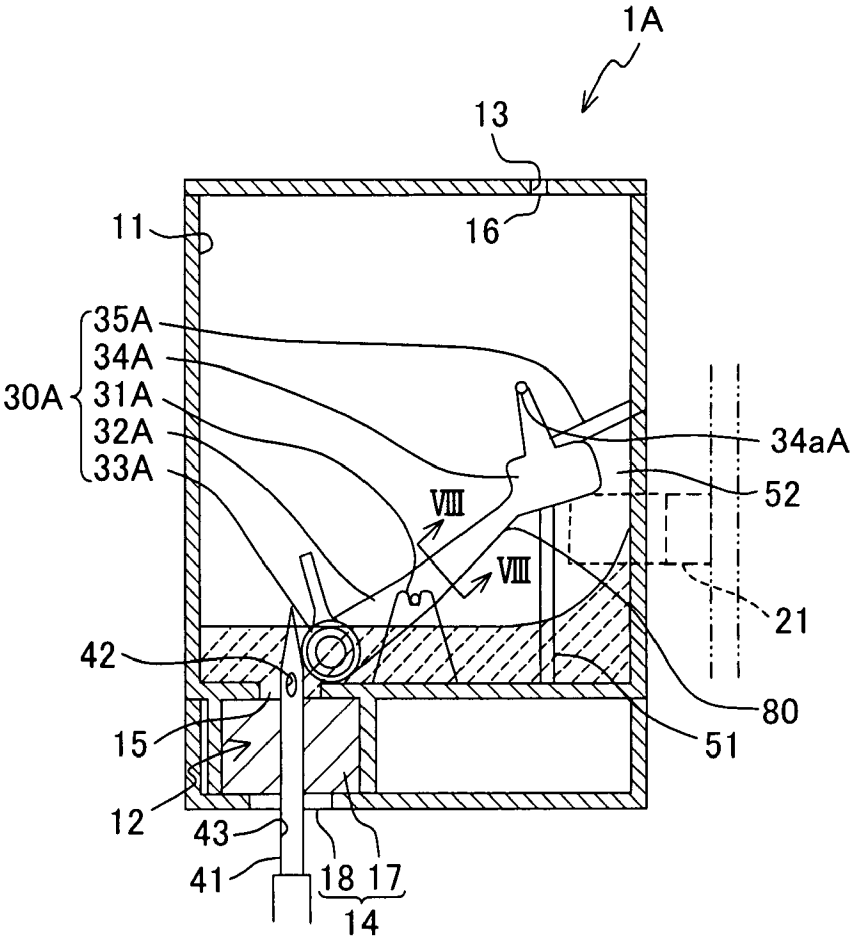
FIGS. 7A and 7B show sectional views illustrating an ink cartridge according to a second embodiment.
Figure 7A:
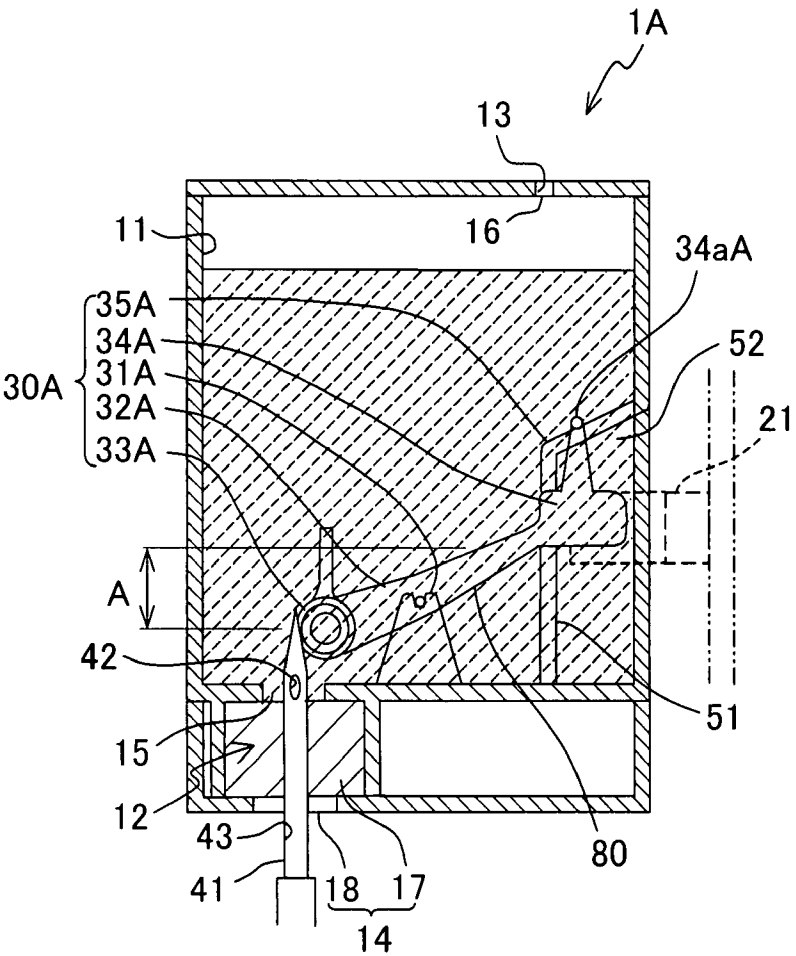
Figure 8:
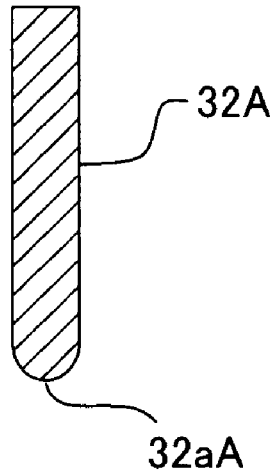
FIG. 8 shows a sectional view taken along a line VIII-VIII shown in FIG. 7.

FIG. 7 shows sectional views illustrating an ink cartridge according to the second embodiment. FIG. 7A shows a state in which the interior of the ink tank 11 is filled with the ink, and FIG. 7B shows a state in which the ink in the ink tank 11 is consumed. FIG. 8 shows a sectional view taken along a line VIII-VIII shown in FIG. 7B. The shutter mechanism 30A of the ink cartridge 1A is driven on the basis of the amount of the ink stored in the ink tank 11. As shown in FIG. 7A, the shutter mechanism 30A is arranged at the bottom of the ink tank 11. The shutter mechanism 30A includes a support stand 31A, a lever (connecting member) 32A, a float (balance member) 33A which is arranged at one end of the lever 32A, a shutter (detection objective section) 34A which is arranged at the other end of the lever 32A, and a regulating member 35A. A swinging member 80 is constructed by the lever 32A, the float 33A, and the shutter 34A.

As shown in FIG. 7, the support stand 31A is a member having a trapezoidal side surface fixed in the vicinity of the center of the bottom of the ink tank 11. The lever 32A is a thin plate-shaped member extending in a certain direction. The lever 32A is supported on the support stand 31 so that the extending direction forms a predetermined angle of inclination with respect to the bottom wall 51*a* (see FIG. 2) of the projection 51 of the ink tank 11. Further, the lever 32A is supported on the support stand 31A so that the lever 32A is swingable about the pivot point at which the lever 32A is supported on the support stand 31. The lever 32A is supported on the support stand 31A so that the width of the projection plane obtained by projecting the lever 32A perpendicularly with respect to the ink liquid surface is narrowest, and the surface (upper surface of the lever 32A in FIG. 7A) of the lever 32A, which may be opposed to the ink liquid surface, has a predetermined angle of inclination with respect to the ink liquid surface. Further, as shown in FIG. 7A, the lever 32A is slightly bent or curved in the vicinity of the center in the extending direction so that the lever 32A is concave upwardly toward the ink tank 11 when the lever 32A is supported on the support stand 31A. As shown in FIG. 8, a curved section (projection) 32*a*A is formed on the surface of the lever 32A which may be opposed to the ink liquid surface.

Figure 9:
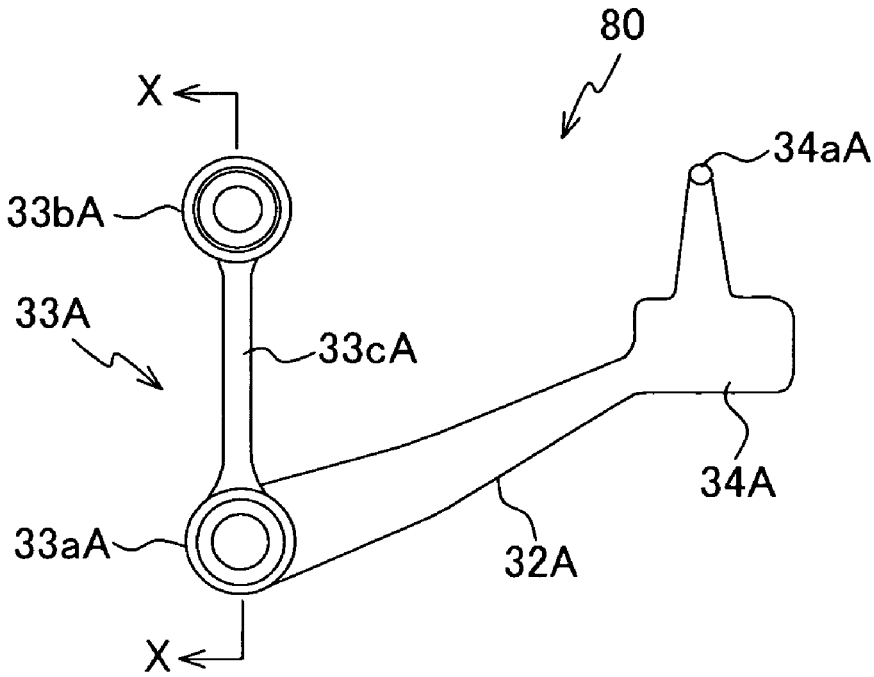
FIG. 9 shows a development illustrating the swinging member shown in FIG. 7.

As shown in FIG. 9, the float 33A is a member having a cylindrical shape. The float 33A has an enormous volume as compared with the shutter 34A as described later on. Further, as described later on, a tightly closed space 36A, which is to be filled with the air, is formed in the float 33A as shown in FIG. 10.

As shown in FIG. 7, the shutter 34A is formed at the end on the side opposite to the side on which the float 33A of the lever 32A is arranged. The shutter 34A is a thin plate member which is nontransparent and substantially rectangular. The shutter 34A is arranged so that the shutter 34A is moved (rotated) in the inner space 52A of the recess 52 formed on the side wall of the ink tank 11 when the lever 32A is subjected to swinging movement. Specifically, as shown in FIG. 7A, when a sufficient amount of the ink is stored in the ink tank 11, and the entire float 33A is positioned in the ink, then the buoyancy, which acts on the float 33A, is larger than the gravity. Therefore, when the float 33A is moved upwardly toward the ink liquid surface, then the lever 32A is rotated in the clockwise direction (first direction) in FIG. 7, and the shutter 34A is arranged at the detecting position (position opposed to the sensor 21) of the recess 52 of the ink tank 11. In this situation, the shutter 34A is arranged so that the width of the projection plane obtained by projecting the shutter 34A perpendicularly with respect to the ink liquid surface is narrowest. In this situation, as shown in FIG. 7A, a rod-shaped abutment member 34*a*A, which is formed at an upper portion of the shutter 34A as described later on, makes abutment against a regulating member 35A so that the shutter 34A is not positioned at any position lower than the detecting position. Accordingly, the rotation of the lever 32A in the first direction is regulated. On the other hand, as shown in FIG. 7B, when the amount of the ink in the ink tank 11 is decreased, and a part of the float 33A protrudes from the liquid surface of the ink, then the gravity, which acts on the float 33A, is larger than the buoyancy. Therefore, as shown in FIG. 7B, the float 33A is moved downwardly toward the bottom surface of the ink tank 11, and the lever 32A is rotated in the counterclockwise direction (second direction) in FIG. 7B. Accordingly, as shown in FIG. 7B, the shutter 34A is arranged at the non-detecting position (position not opposed to the sensor 21) in the vicinity of the upper portion of the recess 52 of the ink tank 11.

As shown in FIG. 7A, an extending portion, which extends upwardly in a state in which the shutter 34A is arranged at the detecting position, is provided at the upper end of the shutter 34A. The rod-shaped abutment member 34*a*A, which is mounted in the perpendicular direction (direction perpendicular to the sheet surface of the drawing) with respect to the both side surfaces of the extending portion, is formed in the vicinity of the upper end of the extending portion.

As shown in FIG. 7A, the regulating member 35A is formed at the upper ends of the recess 52 and the projection 51 of the ink tank 11. The regulating member 35A makes abutment against the abutment member 34*a*A of the shutter 34A when a sufficient amount of the ink is stored in the ink tank 11, and the entire float 33A is positioned in the ink liquid. Accordingly, the regulating member 35A serves as a member which regulates the rotation of the lever 32A in the certain direction (first direction) so that the shutter 34A is not positioned at any position lower than the detecting position.

As described above, in the second embodiment, as shown in FIG. 7A, when the ink amount in the ink tank 11 is large, and the entire float 33A is positioned in the ink liquid, then the abutment member 34*a*A abuts against the regulating member 35A, the shutter 34A is arranged at the detecting position of the recess 52, and the shutter 34A is arranged at the position higher than the float 33A. Further, in the second embodiment, the portion of the lever 32A, which is disposed in the vicinity of the center in the extending direction, is slightly bent or curved so that the portion is concave upwardly toward the ink tank 11. Therefore, the shutter 34A is arranged at the upper position as compared with the case in which the lever 32A is not bent or curved.

Figure 10A:
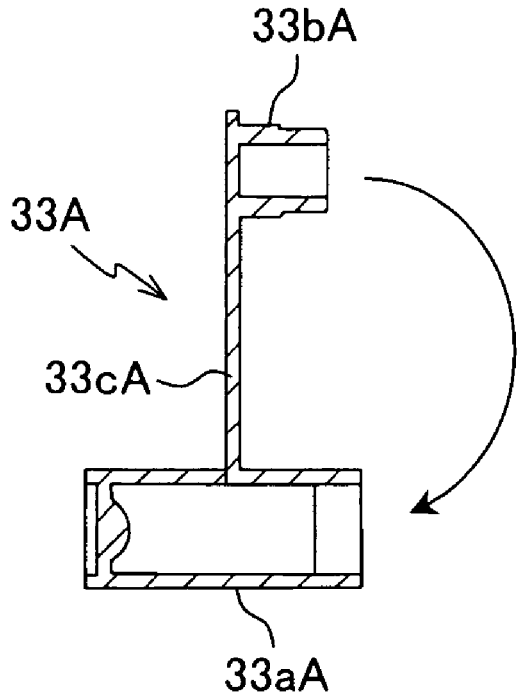
FIG. 10 shows sectional views taken along a line X-X shown in FIG. 9.
Figure 10B:
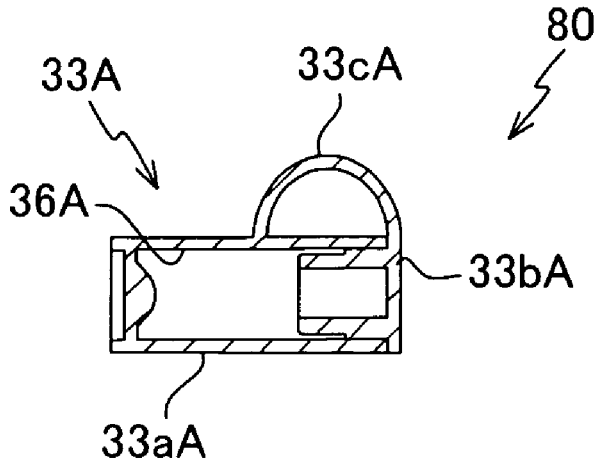

An explanation will be made with reference to FIGS. 9 and 10 about the structure of the swinging member 80. FIG. 9 shows a development illustrating the swinging member 80. FIG. 10 shows sectional views taken along a line X-X shown in FIG. 9. FIG. 10A shows a sectional view illustrating a developed state of the float 33A, and FIG. 10B shows a sectional view illustrating an assembled state of the float 33A. The swinging member 80 is made of a polypropylene resin. As shown in FIG. 9, the swinging member 80 is integrally formed in a state in which the float 33A is developed. As shown in FIG. 10A, the float 33A includes a case 33*a*A, a cap 33*b*A, and a connecting member 33*c*A. As shown in FIG. 10A, the case 33*a*A is a member having a cylindrical shape extending in a certain direction. The case 33*a*A is provided with the inner space having an opening disposed at one end. The cap 33*b*A is a member for tightly sealing the inner space of the case 33*a*A. The connecting member 33*c*A is a plate-shaped member for connecting the case 33*a*A and the cap 33*b*A. The connecting member 33*c*A has one end which is joined to a portion in the vicinity of the center in the extending direction of the case 33*a*A and the other end which is joined to the end surface of the cap 33*b*A.

When the developed swinging member 80 is assembled, then the connecting member 33*c*A is bent as shown in FIG. 10A, and the end of the cap 33*b*A, which is disposed on the side opposite to the end surface connected to the connecting member 33*c*A, is arranged at the opening of the case 33*a*A (arrow shown in FIG. 10A). As shown in FIG. 10B, the inner space of the case 33*a*A is tightly sealed by engaging the cap 33*b*A with the opening of the case 33*a*A. Accordingly, the tightly closed space 36A is formed. The specific gravity of polypropylene as the material for forming the swinging member 80 is 0.9. Therefore, in this embodiment, it is preferable that the ratio K of the volume of the tightly closed space 36A with respect to the volume of the float 33A is within a range of not less than 0.3 and not more than 0.5 (see the expression (5)).

According to the second embodiment explained above, as shown in FIG. 7A, the arranged position of the float 33A is lower than the lower end of the shutter 34A. Therefore, when the amount of the ink in the ink tank 11 is decreased, the shutter 34A protrudes from the ink liquid surface prior to the float 33A. Therefore, the float 33A protrudes from the ink liquid surface to rotate the lever 34A after the ink adhered in the vicinity of the shutter 34A flows down. Accordingly, it is possible to reduce the influence of the surface tension of the ink when the shutter 34A is rotated. It is possible to indicate the correct ink amount.

According to the second embodiment, the lever 32A is arranged so that the width of the projection plane obtained by perpendicularly projecting the lever 32 with respect to the ink liquid surface is narrowest. Therefore, it is possible to decrease the contact area between the lever 32A and the ink liquid surface. Accordingly, it is possible to reduce the influence of the surface tension of the ink on the lever 32A when the lever 32A is rotated, and it is possible to indicate the ink amount more correctly.

According to the second embodiment, as shown in FIG. 7A, the lever 32A is arranged so that the side wall of the lever 32A, which may be opposed to the ink liquid surface, is inclined with respect to the ink liquid surface. Therefore, it is possible to further decrease the contact area between the lever 32A and the ink liquid surface. The lever 32 is arranged obliquely with respect to the ink liquid surface which is lowered as the ink is consumed. Therefore, it is easy for the lever 32 to effect the liquid cutoff for the ink as well. The shutter mechanism 30 is moved more smoothly. Accordingly, it is possible to further reduce the influence of the surface tension of the ink on the lever 32A.

According to the second embodiment, as shown in FIG. 8, the curved section 32*a*A is formed on the side wall of the lever 32A which may be opposed to the ink liquid surface. Therefore, it is possible to further decrease the contact area between the lever 32A and the ink liquid surface. Accordingly, it is possible to further reduce the influence of the surface tension of the ink on the lever 32A.

Additionally, according to the second embodiment, the float 33A is formed of polypropylene having the specific gravity of 0.9 which is lighter than the specific gravity of the ink. Therefore, it is easy to increase the buoyancy generated on the float 33A. This contributes to the miniaturization of the float 33A. Even when the ink enters the tightly closed space 36A, it is possible to generate the buoyancy on the float 33A, because the specific gravity of the float 33A is lighter than the specific gravity of the ink.

According to the second embodiment, the tightly closed space 36A is formed in the float 33A by engaging the case 33*a*A and the cap 33*b*A of the swinging member 80 formed in an integrated manner. Therefore, the float 33A can be produced easily and cheaply.

According to the second embodiment, the shutter 34A is arranged so that the width of the projection plane obtained by perpendicularly projecting the shutter 34A with respect to the ink liquid surface is narrowest. Therefore, it is possible to decrease the contact area between the shutter 34A and the ink liquid surface. Accordingly, it is possible to reduce the influence of the surface tension of the ink on the shutter 34A when the shutter 34A is rotated.

Third Embodiment

A third embodiment of the present invention will be explained. In the third embodiment, the present invention is applied to an ink-jet printer capable of discharging four color inks.

Figure 11:
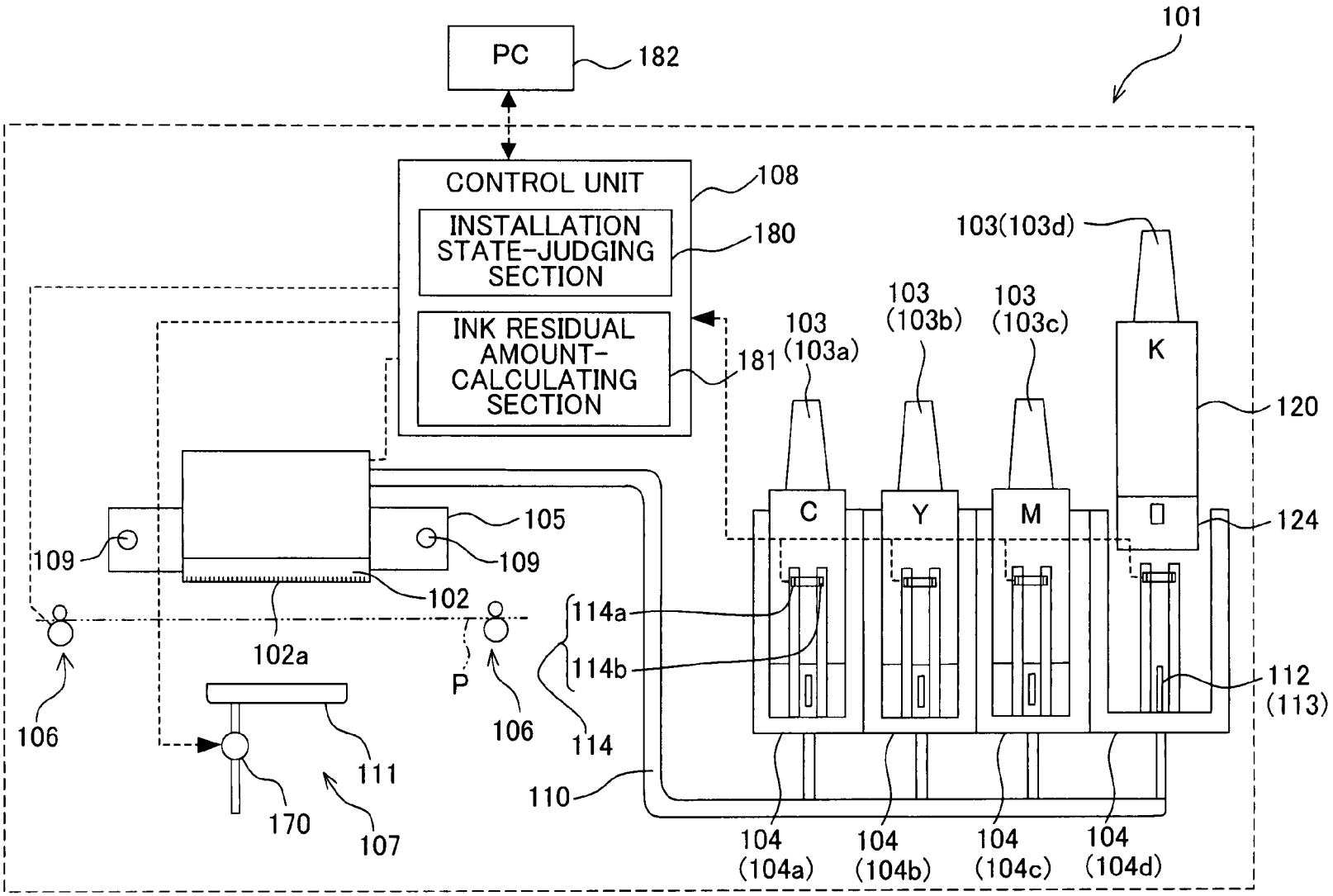
FIG. 11 shows a schematic arrangement of an ink-jet printer according to a third embodiment.

As shown in FIG. 11, the ink-jet printer 101 includes, for example, an ink-jet head 102 which is provided with nozzles 102*a* for discharging the four color inks of cyan (C), yellow (Y), magenta (M), and black (K) to the recording paper P, four holders 104 (104*a*, 104*b*, 104*c*, 104*d*) which serve as cartridge-installing sections for installing four ink cartridges 103 (103*a*, 103*b*, 103*c*, 103*d*) for storing the four color inks respectively, a carriage 105 which linearly reciprocates and moves the ink-jet head 102 along a guide 109 in a certain direction (direction perpendicular to the paper surface), a transport mechanism 106 which transports the recording paper P in the direction perpendicular to the direction of movement of the ink-jet head 102 in parallel to the ink discharge surface of the ink-jet head 102, a purge unit 107 which sucks the ink having any high viscosity and the air contained in the ink-jet head 102, and a control unit 108 which manages the control of the entire ink-jet printer 101.

In the ink-jet printer 101, the recording paper P is transported by the transport mechanism 106 in the rightward and leftward directions in FIG. 11, while driving and reciprocating the ink-jet head 102 by the carriage 105 in the direction perpendicular to the paper surface in FIG. 11. In cooperation thereto, the ink is supplied to the nozzles 102*a* of the ink-jet head 102 through the supply tube 110 from the holder 104 installed with the ink cartridge 103. Further, the ink is discharged from the nozzles 102*a* to the recording paper P, and the recording paper P is subjected to the printing.

As shown in FIG. 11, the purge unit 107 includes a purge cap 111 which can be installed to the ink-jet head 102 so that the ink discharge surface is covered therewith, and a suction pump 170 which sucks the ink from the nozzles 102*a*. The purge unit 107 is arranged at the position opposed to the ink-jet head 102 with the recording paper P intervening therebetween. The purge unit 107 is movable in the direction to make approach or separation with respect to the ink discharge surface of the ink-jet head 102. When the ink-jet head 102 is out of a printing range in which the recording paper P can be subjected to the printing, the suction pump 170 can be used to suck the air mixed into the ink-jet head 102 and/or the ink having any high viscosity as a result of the evaporation of water from the nozzles 102*a*.

As shown in FIG. 11, the four holders 104*a* to 104*d* are provided in the ink-jet printer 101 while being aligned in one array in the ink-jet printer 101. The four ink cartridges 103*a* to 103*d*, which store the inks of cyan, yellow, magenta, and black, are installed to the four holders 104*a* to 104*d* respectively. The black ink of the four color inks is used more frequently than the other three color inks in many cases. In such a case, it is preferable that the volume of the ink cartridge for the black ink is larger than those of the ink cartridges 103*a* to 103*c* for the color inks.

An ink supply pipe (communicating pipe) 112 and an atmospheric air-introducing pipe 113 are provided upstandingly respectively at positions corresponding to an ink supply valve 121 and an atmospheric air-introducing valve 122 of the ink cartridge 103 respectively at the bottom of the holder 104 as described later on. An optical type sensor 114 (light-transmissive type optical sensor) is provided for the holder 104 in order to detect the ink residual amount in the ink cartridge 103. The sensor 114 has a light-emitting section 114*a* and a light-receiving section 114*b* which are arranged at an identical height position and which are opposed to one another so that the ink cartridge 103 is interposed between the both sides. It is detected whether or not the light from the light-emitting section 114*a* is blocked by a shutter mechanism 123 provided in the ink cartridge 103 as described later on. An obtained detection result is outputted to the control unit 108.

Next, the ink cartridge 103 will be explained in detail. In this embodiment, the ink cartridges 103*a* to 103*c*, which store the three types of color inks respectively, have the same structure as that of the ink cartridge 103*d* which stores the black ink. Therefore, one of the ink cartridges 103 will be explained.

Figure 12A:
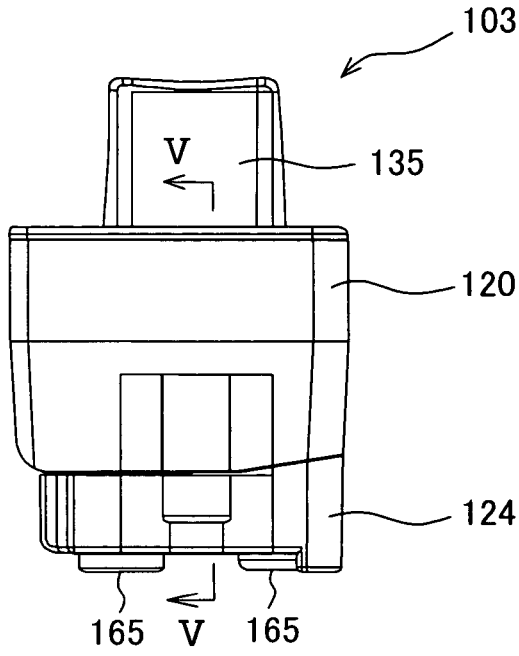
FIG. 12A shows a plan view.
Figure 12B:
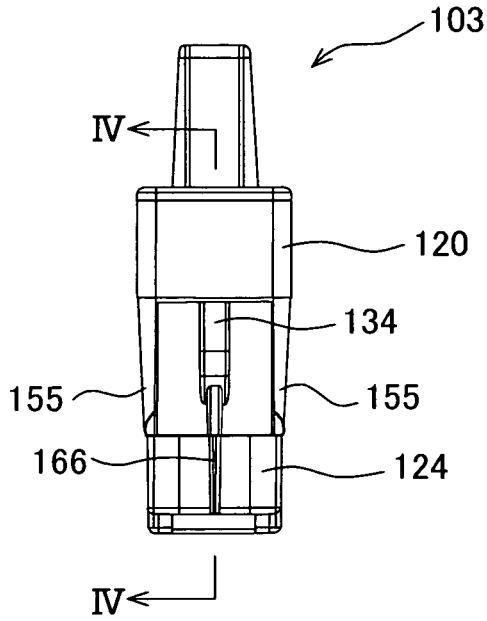
FIG. 12B shows a left side view.
Figure 12C:
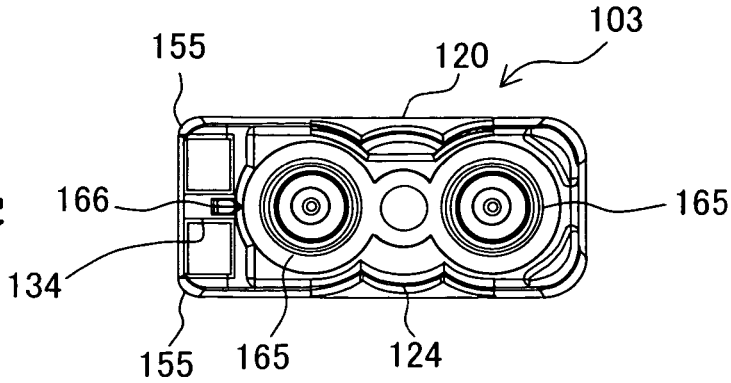
FIG. 12C shows a bottom view.
Figure 13:
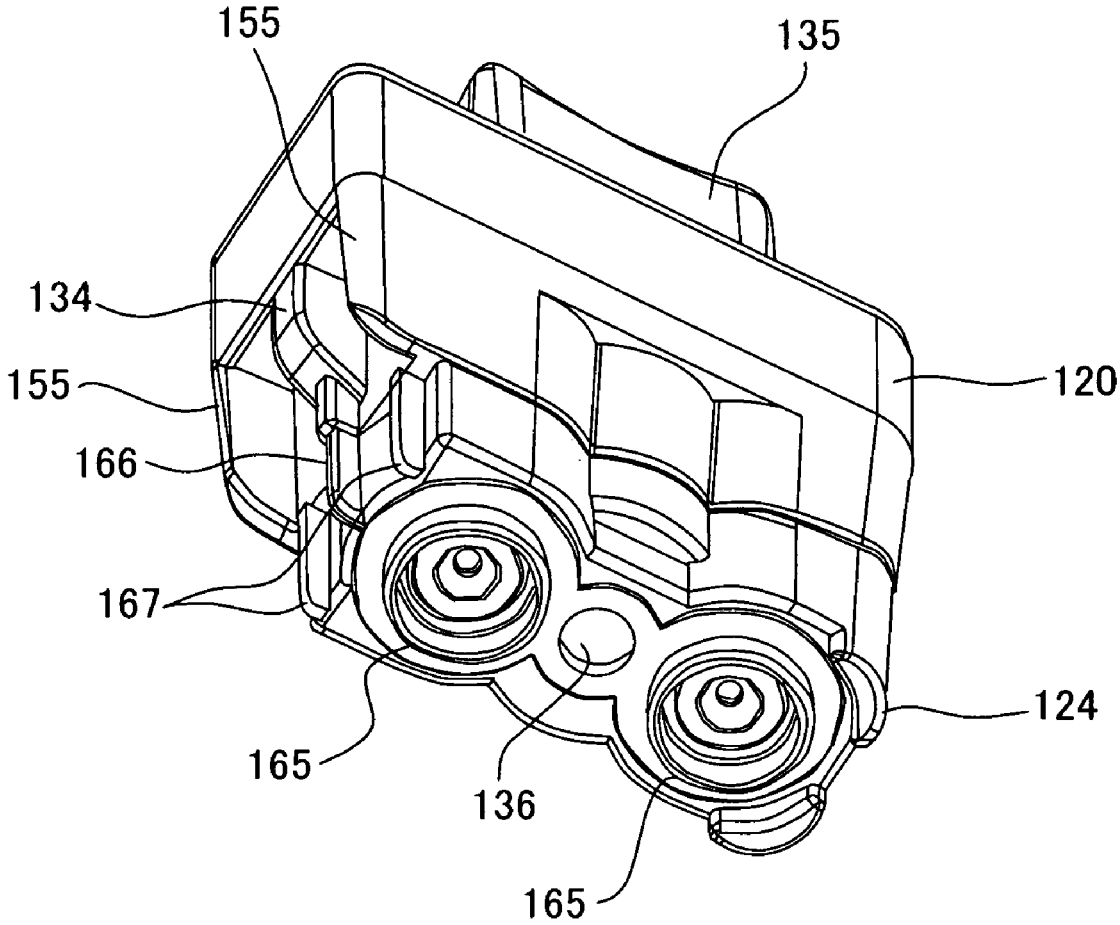
FIG. 13 shows a perspective view illustrating the ink cartridge depicted in FIG. 11 as viewed from a downward position.
Figure 14:
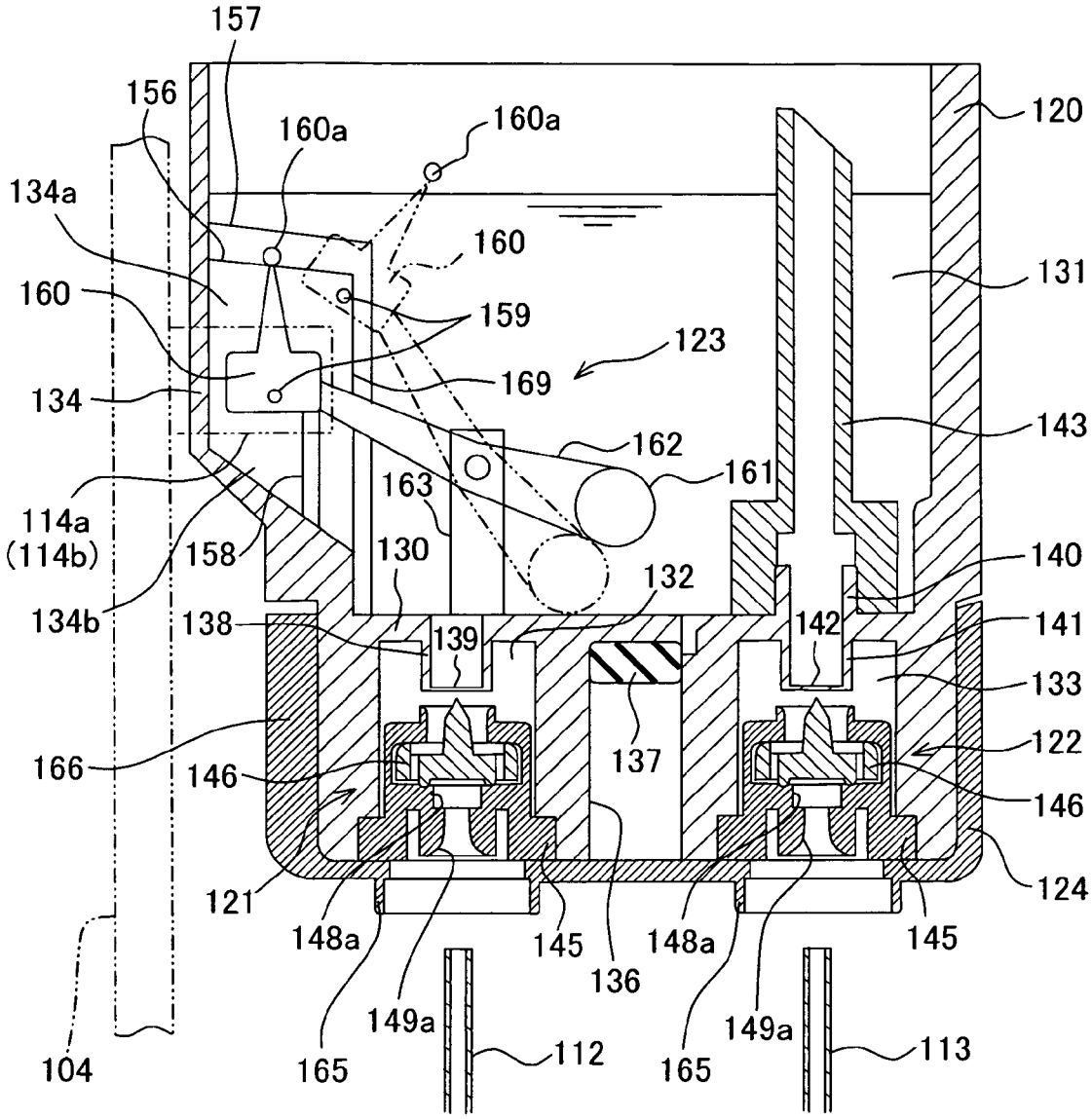
FIG. 14 shows a sectional view taken along a line IV-IV shown in FIG. 12B.

As shown in FIGS. 12 to 14, the ink cartridge 103 includes a cartridge main body 120 which stores the ink, an ink supply valve 121 which is capable of opening/closing the ink supply passage to supply the ink contained in the cartridge main body 120 to the ink-jet head 102, an atmospheric air-introducing valve 122 which is capable of opening/closing the atmospheric air-introducing passage to introduce the atmospheric air into the cartridge main body 120 from the outside, a shutter mechanism 123 which blocks the light emitted from the light-emitting section 114*a* of the sensor 114 for detecting the ink residual amount in the ink cartridge 103, and a cap 124 which covers the lower end of the cartridge main body 120.

The cartridge main body 120 is formed of a light-transmissive synthetic resin. As shown in FIG. 14, a comparting wall 130, which extends horizontally, is integrally formed in the cartridge main body 120. The inner space of the cartridge main body 120 is comparted by the comparting wall 130 into an ink chamber (ink tank) 131 which is disposed on the upper side, and two valve-accommodating chambers 132, 133 which disposed on the lower side. The ink chamber 131 is charged with each of the color inks. The ink supply valve 121 and the atmospheric air-introducing valve 122 are accommodated in the two valve-accommodating chambers 132, 133 respectively. In this arrangement, the ink supply passage, which is used to introduce the ink charged in the ink chamber 131 to the outside, is constructed in the valve-accommodating chamber 132. As described later on, the ink flow, which is directed downwardly from the side of the ink chamber 131, is formed in the ink supply passage (see FIG. 19B). As shown in FIGS. 12B and 12C, a projection 134, which slightly protrudes outwardly and which extends in the downward direction, is formed at a substantially central position in the height direction of the side wall of the cartridge main body 120. The light-emitting section 114*a* and the light-receiving section 114*b* of the sensor 114 provided for the holder 104 are positioned at a height approximately equal to that of the projection 134 formed on the side wall of the cartridge main body 120 in a state in which the ink cartridge 103 is installed to the holder 104.

Figure 15:
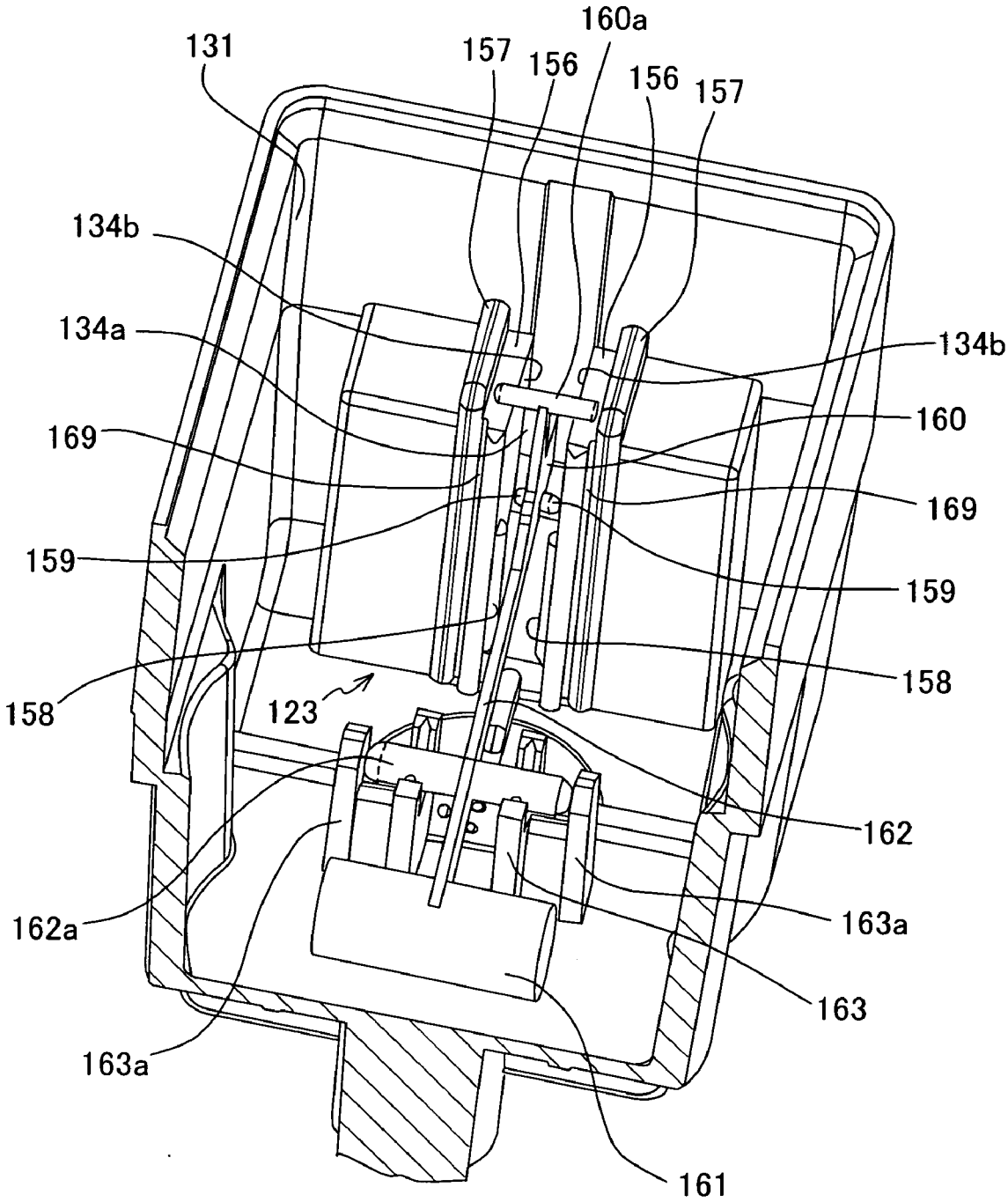
FIG. 15 shows a perspective view with cross section taken along a line V-V shown in FIG. 12A.
Figure 16:
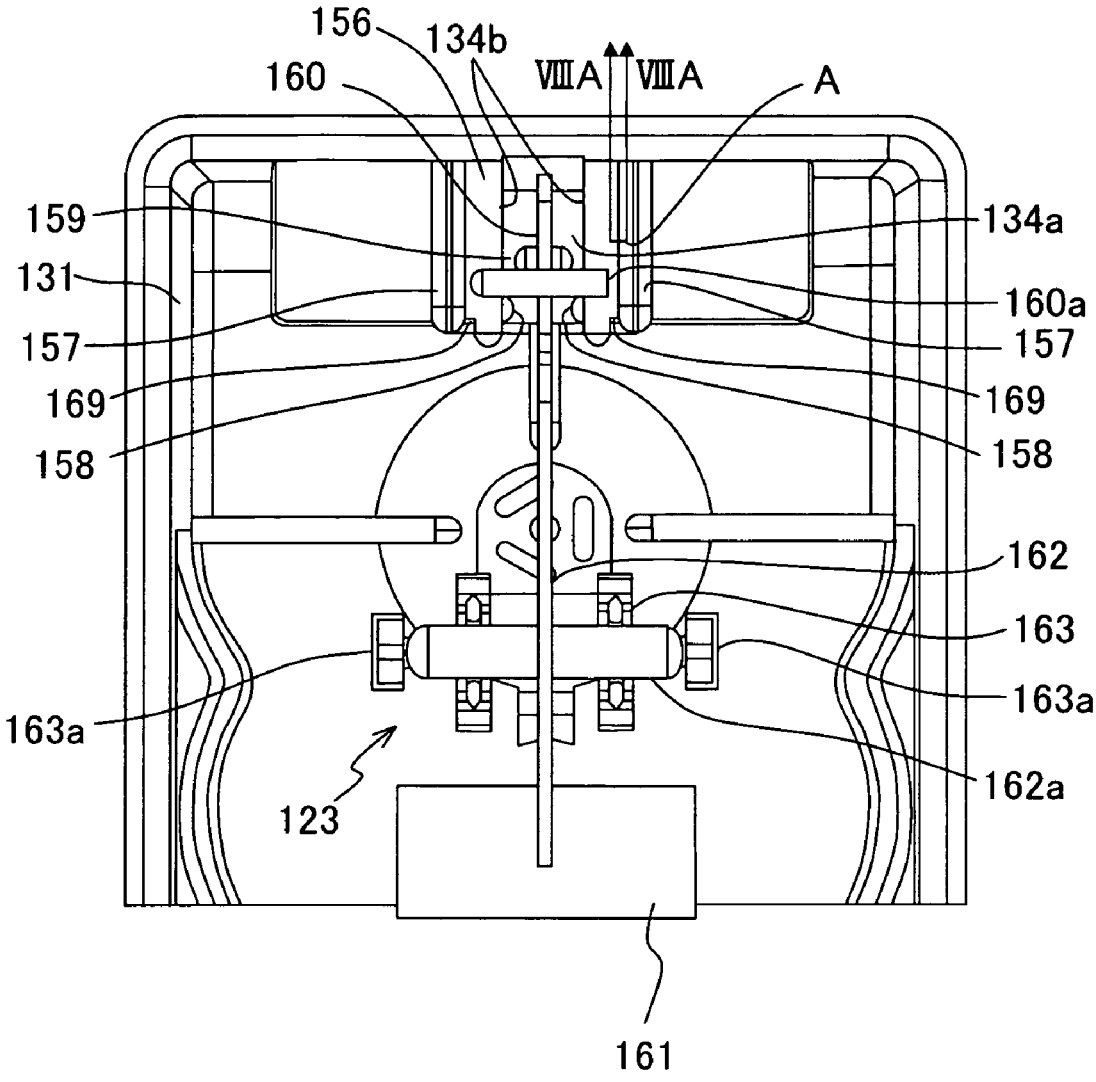
FIG. 16 shows a top view with cross section taken along the line V-V shown in FIG. 12A.
Figure 17:
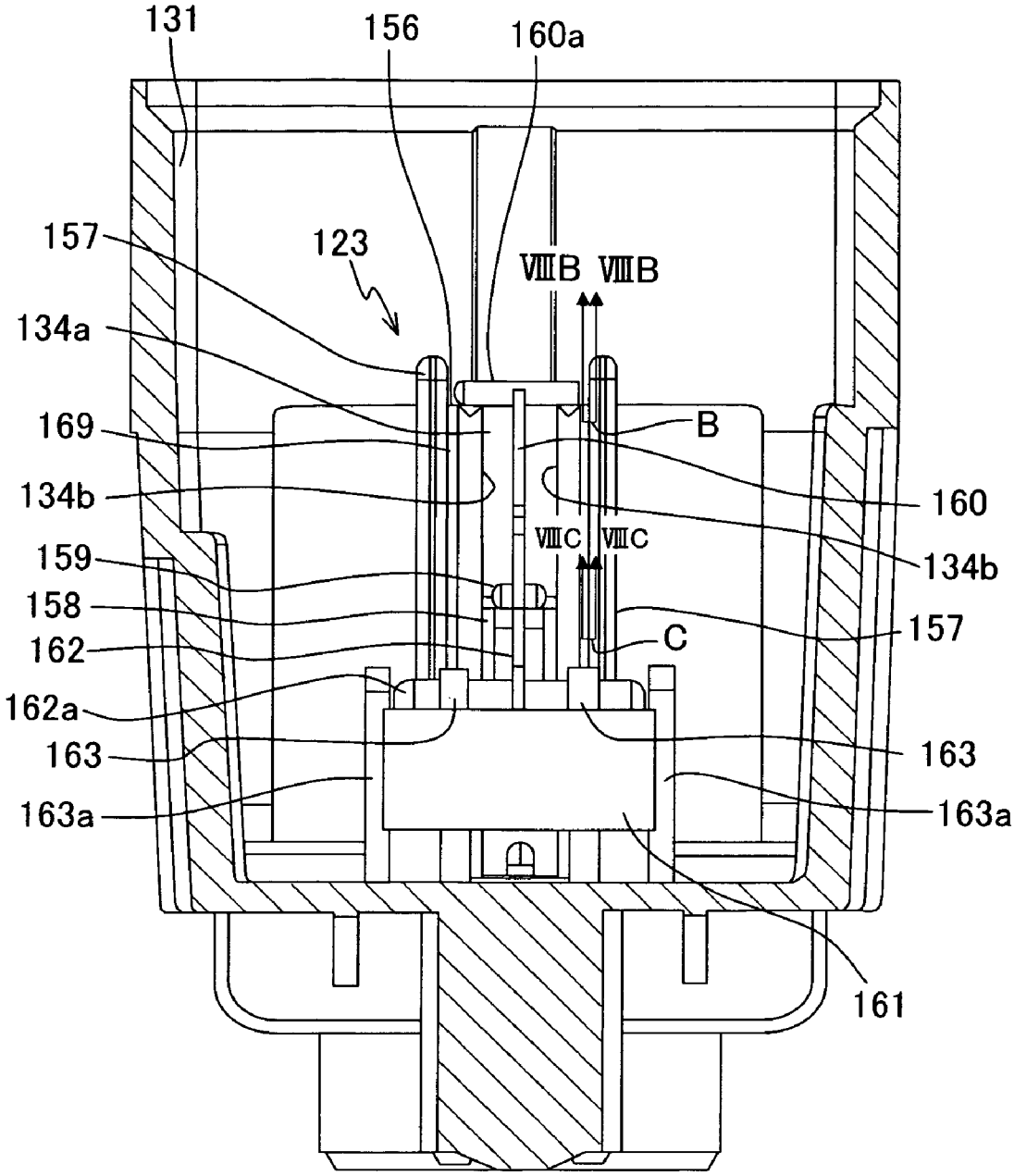
FIG. 17 shows a front view with cross section taken along the line V-V shown in FIG. 12A.
Figure 18A:
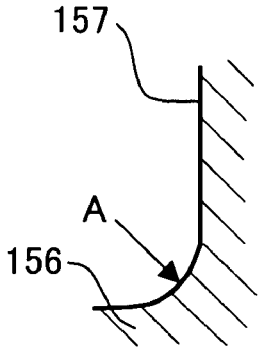
FIG. 18A shows a sectional view taken along a line VIIIA-VIIIA shown in FIG. 16.
Figure 18B:
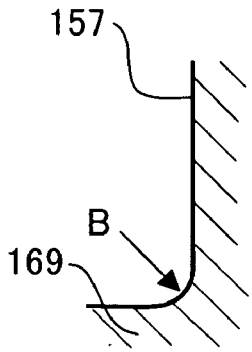
FIG. 18B shows a sectional view taken along a line VIIIB-VIIIB shown in FIG. 16.
Figure 18C:
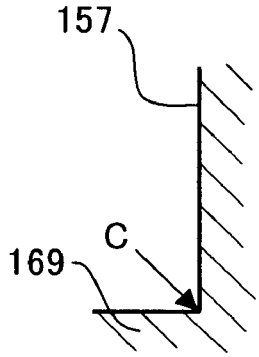
FIG. 18C shows a sectional view taken along a line VIIIC-VIIIC shown in FIG. 17.

As shown in FIGS. 15 to 17, a recess 134*a* is formed at the inside of the projection 134 in the ink chamber 131. As shown in FIGS. 15 to 17, the recess 134*a* extends in the direction (direction inclined downwardly) perpendicular to the ink surface, and the recess 134*a* has two inner wall surfaces (downwardly inclined inner surfaces) 134*b* which are opposed to one another. As shown in FIGS. 15 to 17, a shield plate (detection objective section) 160 of the shutter mechanism 123 described later on is arranged in the recess 134*a* so that the shield plate 160 is interposed between the two inner wall surfaces 134*b* of the recess 134*a*. As shown in FIGS. 15 to 17, a rib 158, which protrudes toward the shield plate 160 arranged in the recess 134*a* and which extends in the perpendicular direction, is formed on each of the inner wall surfaces 134*b*. As shown in FIGS. 15 to 17, two abutment objective surfaces (regulating surfaces) 156, which extend in directions to make separation from each other in an identical plane from the upper ends of the respective inner wall surfaces 134*b*, are formed in the ink chamber 131. The abutment objective surfaces 156 are surfaces to make abutment against abutment sections 160*a* formed at the upper end of the shield plate 160 as described later on. The abutment objective surfaces 156 are inclined surfaces each of which is inclined by a predetermined angle toward the bottom surface of the ink chamber 131 (to make intersection with the ink surface) (see FIG. 14). As shown in FIGS. 15 to 17, perpendicular wall surfaces 169, each of which is connected to the end of the inner wall surface 134*b* disposed on the side opposite to the side of connection to the inner wall of the ink chamber 131 and the end of the abutment objective surface 156 disposed on the side opposite to the side of connection to the inner wall of the ink chamber 131, are formed in the ink chamber 131. As shown in FIGS. 15 to 17, ribs 157 are formed so that each of them extends over the abutment objective surface 156 and the perpendicular wall surface 169 and each of them is disposed perpendicularly to the extending direction of the abutment section 160*a* which makes abutment against the abutment objective surface 156. In a state in which the abutment section 160*a* abuts against the abutment objective surfaces 156, as shown in FIG. 15, the tips of the abutment section 160*a* are disposed adjacently and opposingly to the side surfaces of the ribs 157. As shown in FIGS. 15 to 17, the rib 157 is formed continuously over the range from the end of the abutment objective surface 156 on the side of the inner wall of the ink chamber 131 to the end opposed thereto and over the range from the end of the perpendicular wall surface 169 on the side of the abutment objective surface 156 to the end opposed thereto. FIG. 18 shows cross sections of the boundaries between the rib 157 and the abutment objective surface 156 and the perpendicular wall surface 169. In the case of the ink cartridge of this embodiment, as shown in FIG. 18, the radius of curvature of the boundary differs depending on the position of connection between the rib 157 and the abutment objective surface 156 and the perpendicular wall surface 169. FIG. 18A shows the cross section illustrating the boundary between the rib 157 and the abutment objective surface 156. FIG. 18B shows the cross section illustrating the boundary between the rib 157 and the upper end area of the perpendicular wall surface 169. FIG. 18C shows the cross section illustrating the boundary between the rib 157 and the lower end area of the perpendicular wall surface 169. As shown in FIGS. 18A to 18C, the curvature of the curved section (A in FIG. 18A) formed at the boundary between the rib 157 and the abutment objective surface 156 is smaller than the curvatures of the curved sections (B and C in FIGS. 18B and 18C) formed at the boundaries between the rib 157 and the perpendicular wall surface 169. The curvature of the curved section (B in FIG. 18B) formed at the boundary between the rib 157 and the upper end area of the perpendicular wall surface 169 is smaller than the curvature of the curved section (C in FIG. 18C) formed at the boundary between the rib 157 and the lower end area of the perpendicular wall surface 169.

As shown in FIGS. 14 to 17, the shutter mechanism 123 which is provided in the lower space of the ink chamber 131 includes a shield plate 160 (detection objective section) which is nontransparent with respect to the light, a hollow float 161 (balance member), a connecting member 162 which connects the shield plate 160 and the float 161, and a support stand 163 which is provided on the upper side of the comparting wall 130 and which rotatably supports the connecting member 162. The displacement member (swinging member) is constructed by the shield plate 160, the float 161, and the connecting member 162. The float 161 is a cylindrical member having a tightly closed space filled with the air therein. The specific gravity of the entire float 161 is smaller than the specific gravity of the ink to be changed in the ink chamber 131. The shield plate 160 and the float 161 are provided at both ends of the connecting member 162 respectively. A columnar rotational shaft 162*a*, which protrudes in directions perpendicular to the both side surfaces of the connecting member 162, is formed in the vicinity of the center in the extending direction of the connecting member 162. The connecting member 162 is supported on the support stand 163 rotatably in the vertical plane (in the plane parallel to the sheet surface of the drawing) about the center of the rotational shaft 162*a*.

As shown in FIGS. 14 to 17, the rotational shaft 162*a*, which is formed on the connecting member 162, protrudes from the flat surfaces on both sides of the connecting member 162 in the direction perpendicular to the direction of displacement of the ink surface. In order to smoothen the rotation of the connecting member 162, the rotational shaft

162*a* is supported on the support stand 163 such that the rotational shaft 162*a* is also rotatable to some extent in the plane parallel to the sheet surface of FIG. 16. That is, the support stand 163 supports, at the lower position, the swinging member so that the motion other than the rotation of the connecting member 162 about the center of the rotational shaft 162*a* is also allowable. The tips of the rotational shaft 162*a* in the protruding directions, which protrude from the both side surfaces of the connecting member 162, abut against side wall surfaces on the mutually opposing sides of a pair of support plates 163*a* provided upstandingly from the bottom surface (comparting wall 130 as described later on) of the ink chamber 131. Accordingly, the displacement of the entire swinging member is regulated in the rightward and leftward directions on the sheet surface of FIG. 16.

The shield plate 160 is a thin plate-shaped member which is parallel to the vertical plane (plane parallel to the sheet surface of FIG. 14) and which has a predetermined area. As shown in FIG. 14, the shield plate 160 has a rectangular area, and a triangular protruding area which is formed to further extend upwardly from the upper end of the rectangular area. The abutment section 160*a*, which has a columnar shape extending from the shield plate 160 toward the two ribs 157 (in the direction along the ink surface), is formed at the upper end of the protruding area. The abutment section 160*a* makes abutment against the abutment objective surface 156 in the ink chamber 131. Accordingly, the rotation of the connecting member 162 in the certain direction (first direction) is regulated to arrange the shield plate 160 at a predetermined position. Specifically, as shown in FIG. 14, when the abutment section 160*a* abuts against the abutment objective surface 156, the shield plate 160 is arranged at the detecting position between the light-emitting section 114*a* and the light-receiving section 114*b* of the recess 134*a*. In this situation, the light, which has transmitted from the light-emitting section 114*a* of the sensor 114 through the wall of the light-transmissive cartridge main body 120 and the ink in the ink chamber 131, is blocked by the shield plate 160. On the other hand, when the abutment section 160*a* is separated from the abutment objective surface 156 (when the swinging member is in a state indicated by two-dot chain lines in FIG. 14), the shield plate 160 is arranged at any position other than the detecting position. In this situation, the light transmitted from the light-emitting section 114*a* arrives at the light-receiving section 114*b* without being blocked.

Therefore, in a state in which the ink residual amount in the ink chamber 131 is large, and the entire float 161, which is provided at one end of the connecting member 162, is positioned in the ink (in a situation in which the swinging member is in a state illustrated by solid lines in FIG. 14), the float 161 floats in accordance with the buoyancy acting on the float 161, and the connecting member 162 is rotated. However, the abutment section 160*a* of the shield plate 160 abuts against the abutment objective surface 156, and the rotation of the connecting member 162 is regulated. Therefore, the shield plate 160, which is provided at the other end of the connecting member 162, is arranged at the detecting position, i.e., at the position at which the light emitted from the light-emitting section 114*a* in the projection is blocked. However, when the ink residual amount in the ink chamber 131 is decreased, and a part of the float 161 protrudes from the ink liquid surface, then the buoyancy acting on the float 161 is decreased, and the float 161 is moved downwardly in accordance with the gravity (in a state in which the swinging member is indicated by two-dot chain lines in FIG. 14). Accordingly, the shield plate 160 is moved to the position (non-detecting position) which is disposed upwardly as compared with the interior of the projection 134 so that the direct light emitted from the light-emitting section 114*a* is not blocked by the shield plate 160. Therefore, the direct light emitted from the light-emitting section 114*a* is transmitted through the light-transmissive projection 134 along the linear optical path, and the light is directly received by the light-receiving section 114*b*. Accordingly, the state, in which the ink residual amount in the ink chamber 131 is decreased, is detected by the sensor 114.

As shown in FIGS. 14 to 17, columnar pins (projections) 159, which protrude from the shield plate 160 toward the inner wall surfaces 134*b* of the recess 134*a*, are formed on the both side surfaces of the rectangular area of the shield plate 160 (in the vicinity of the end of the swinging member) respectively. The tip of the pin 159 is constructed to form a curved surface. As shown in FIG. 14, the tips of the pins 159 are always in a state of being opposed to the inner wall surfaces 134*b* of the recess 134*a* within a range of movement of the abutment section 160*a* between the position at which the abutment section 160*a* abuts against the abutment objective surfaces 156 and the position at which the abutment section 160*a* is separated from the abutment objective surfaces 156. The pin 159 has an amount of projection to form a gap of such an extent that no capillary phenomenon is caused by at least the surface tension of the ink between the shield plate 160 and the inner wall surface 134*b* even when the tip of the pin 159 abuts against the inner wall surface 134*b* of the recess 134*a*, and the shield plate 160 makes approach most closely to the inner wall surface 134*b*.

In this structure, in a state in which the ink cartridge 103 is installed to the holder 104, the projection 134 of the ink cartridge main body 120 is interposed between the light-emitting section 114*a* and the light-receiving section 114*b* of the sensor 114. In this situation, the width of the projection 134 is narrower than the distance between the light-emitting section 114*a* and the light-receiving section 114*b*. Therefore, a predetermined spacing distance is maintained between the light-emitting section 114*a* and the light-receiving section 114*b* and the projection 134. As shown in FIGS. 12 and 13, a pair of ribs 155, which extend in the same direction as the extending direction of the projection 134 so that the projection 134 is interposed therebetween, are provided for the cartridge main body 120 at the both ends in the horizontal direction (leftward/rightward direction of the sheet surface in FIG. 12B) on the outer wall surface on which the projection 134 is formed. A lid member 135 is welded to the upper end of the cartridge main body 120. The ink chamber 131 in the cartridge main body 120 is closed by the lid member 135.

As shown in FIG. 14, an injecting hole 136 is formed between the two valve-accommodating chambers 132, 133 in order to inject the ink into the ink chamber 131 of the empty ink cartridge 103. A plug member 137 made of synthetic rubber is forcibly inserted into the injecting hole 136. As shown in FIG. 14, an opening, which makes communication with the ink chamber 131 in the cartridge main body 120, is formed through a part of the injecting hole 136 in the vicinity of the upper end of the side wall. When the ink is charged, the plug member 137 in the injecting hole 136 is pierced by an injection needle (not shown), and the injection needle is penetrated through the opening which is formed through the part of the injecting hole 136 in the vicinity of the upper end of the side wall so that the ink is charged into the ink chamber 131 via the injection needle.

As shown in FIG. 14, a cylindrical section 138, which protrudes downwardly, is integrally formed at a portion of the comparting wall 130 which constitutes the ceiling of the valve-accommodating chamber 132 for accommodating the ink supply valve 121 therein. A thin film section 139, which closes the communication passage formed in the cylindrical section 138, is provided at the lower end of the cylindrical section 138. On the other hand, two cylindrical sections 140, 141, which protrude upwardly and downwardly respectively, are integrally formed at a portion of the comparting wall 130 which constitutes the ceiling of the valve-accommodating chamber 133 for accommodating the atmospheric air-introducing valve 122 therein. A thin film section 142, which closes the communication passage formed in the cylindrical sections 140, 141, is provided at the lower end of the cylindrical section 141 disposed on the lower side. Further, as shown in FIG. 14, a cylindrical member 143, which extends up to the upper end of the ink chamber 131, is provided on the upper side of the cylindrical section 140.

Figure 19A:
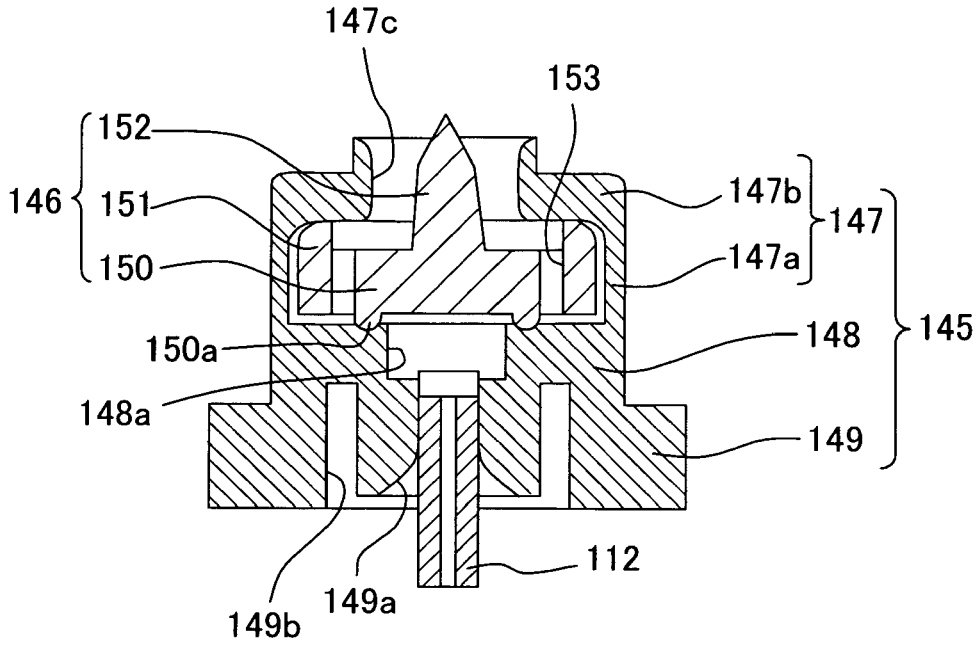
FIG. 19A shows the valve-closed state.

As shown in FIG. 14, the ink supply valve 121 includes a valve main body 145 which is formed to have a substantially cylindrical shape with synthetic rubber or the like and which has elasticity, and a valve plug 146 which is accommodated in the valve main body 145 and which is made of synthetic resin. As shown in FIG. 19, the valve main body 145 includes an urging section 147, a valve seat section 148, and a fitting section 149 which are integrally formed and which are aligned in this order from the upper side (side of the ink chamber 131).

In this structure, the lower surface of the valve plug 146 abuts against the upper surface of the valve seat section 148 (end surface on the side facing the ink chamber 131). A through-hole 148*a*, which extends in the vertical direction, is formed through a portion of the axial center of the valve seat section 148. A guide hole 149*a*, which is communicated with the through-hole 148*a* of the valve seat section 148 and which extends downwardly, is formed for the fitting section 149. The guide hole 149*a* is formed to have a shape widening toward the end in which the diameter is increased at lower positions. An annular groove 149*b* is formed around the guide hole 149*a*. In this structure, the wall for forming the guide hole 149*a* is elastically deformable with ease in the direction in which the diameter of the guide hole 149*a* is expanded. Therefore, when the ink supply pipe 112 is inserted into the guide hole 149*a*, it is possible to avoid the leakage of the ink as far as possible by improving the tight contact performance between the guide hole 149*a* and the ink supply pipe 112. Even when the ink supply pipe 112 is inserted into the guide hole 149*a* in a state in which the ink supply pipe 112 is inclined with respect to the guide hole 149*a* or in a state in which the central axis of the guide hole 149*a* is deviated from the central axis of the ink supply pipe 112, the ink supply pipe 112 is reliably inserted into the guide hole 149*a*, because the wall section is elastically deformed in the direction in which the diameter of the guide hole 149*a* is expanded.

As shown in FIG. 19, the urging section 147 includes a cylindrical side wall section 147*a* which extends from the outer circumferential side portion of the valve seat section 148 toward the side of the ink chamber 131, and a projecting section 147 which integrally protrudes inwardly in the radial direction of the side wall section 147*a* from the upper end of the side wall section 147*a*. The lower surface of the projecting section 147*b* abuts against the valve plug 146. The valve plug 146 is urged downwardly by the elastic forces of the side wall section 147*a* and the projecting section 147*b*. An opening 147*c* is formed at the inside of the projecting section 147*b*. In this construction, the side wall section 147*a* and the projecting section 147*b*, which are formed in an integrated manner, are elastically deformable with ease.

Figure 19B:
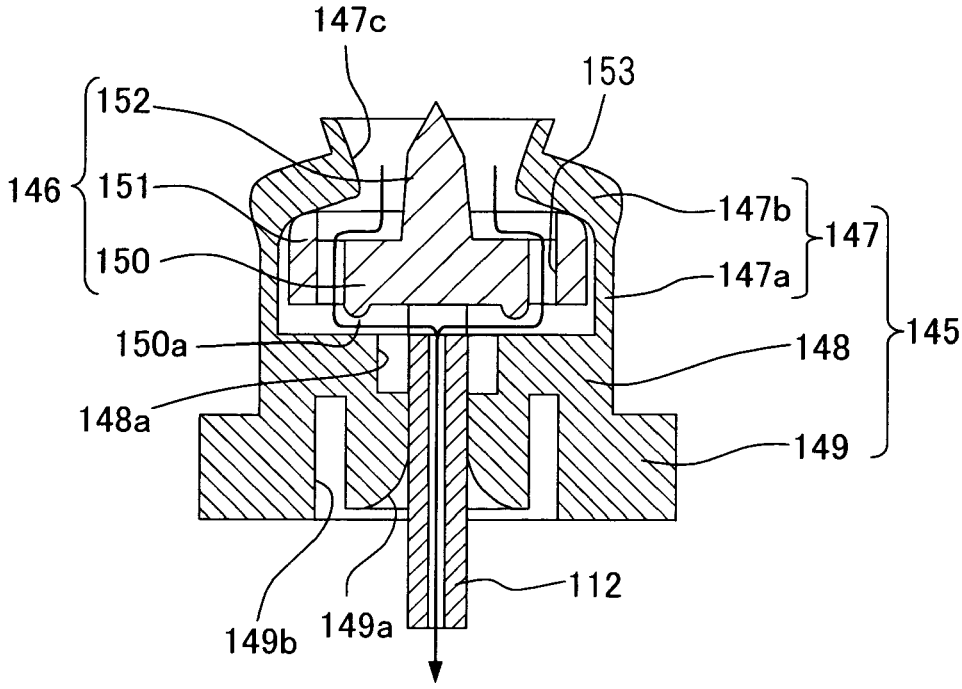
FIG. 19B shows the valve-open state.
Figure 20:
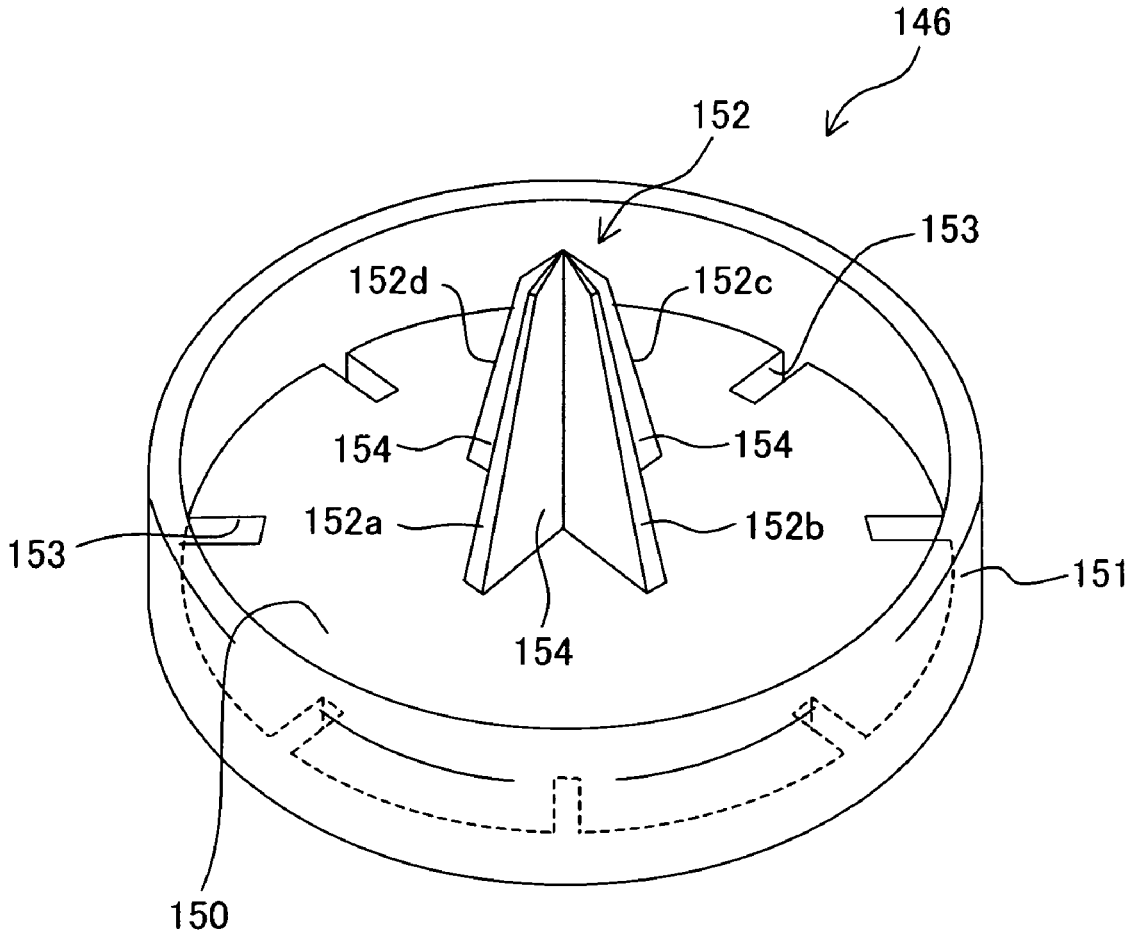
FIG. 20 shows a perspective view illustrating a valve plug depicted in FIG. 15.

As shown in FIGS. 19 and 20, the valve plug 146 includes a bottom section 150 which makes abutment against the valve seat section 148 of the valve main body 145, a cylindrical valve side wall section 151 which extends from the outer circumferential side portion of the bottom section 150 toward the ink chamber 131, and a breaking section 152 which protrudes from the center of the bottom section 150 excessively toward the ink chamber 131 as compared with the valve side wall section 151.

An annular projection 150*a*, which protrudes toward the valve seat section 148, is formed on the lower surface of the bottom section 150 of the valve plug 146 (end surface opposed to the valve seat section 148). The valve plug 146 is urged toward the valve seat section 148 by the urging section 147 of the valve main body 145. In a state (state shown in FIG. 19A) in which the annular projection 150*a* makes tight contact with the upper surface of the valve seat section 148, the through-hole 148*a* of the valve seat section 148 is closed by the valve plug 146, and the ink supply passage is closed. Further, a plurality of (for example, eight) communication passages 153, which make communication between the upper space and the lower space of the valve plug 146, are formed at equally divided positions in the circumferential direction of the portion of the bottom section 150 of the valve plug 146, the portion being disposed on the outer circumferential side as compared with the annular projection 150*a* and on the inner circumferential side as compared with the valve side wall section 151.

As shown in FIGS. 19 and 20, the breaking section 152 of the valve plug 146 is constructed by four plate members 152*a*, 152*b*, 152*c*, 152*d* combined in a cross form as viewed in a plan view. The breaking section 152 is provided upstandingly at a substantially central portion of the bottom section 150. As shown in FIG. 20, grooves 154, which extend in the vertical direction, are formed respectively between the plate members (for example, between the plate members 152*a*, 152*b*) which are combined perpendicularly to one another. The breaking section 152 passes through the opening 147*c* at the inside of the projecting section 147*b* of the valve main body 145 so that the breaking section 152 protrudes upwardly. As shown in FIG. 14, the tip of the breaking section 152 is arranged at the position slightly lower than the thin film section 139 of the cylindrical section 138 before the ink cartridge 103 is installed to the holder 104.

When the ink cartridge 103 is installed to the holder 104, the ink supply pipe 112, which is provided for the holder 104, is inserted into the guide hole 149*a* of the valve main body 145. Accordingly, the valve plug 146 is pushed upwardly by the tip of the ink supply pipe 112 against the urging force of the urging section 147 of the valve main body 145. The valve plug 146 is moved upwardly while deforming the urging section 147. The annular projection 150*a*, which is provided on the bottom surface of the valve plug 146, is separated from the valve seat section 148 (see FIG. 19B). In this situation, the thin film section 139 of the cylindrical section 138 is broken by the tip of the breaking section 152 of the valve plug 146 having been moved upwardly. Accordingly, as shown in FIGS. 14 and 19B, the ink contained in the ink chamber 131 flows into the valve-accommodating chamber 132 through the communication passage in the cylindrical section 138. Further, the ink is supplied through the communication passages 153 of the valve plug 146 from the ink supply pipe 112 to the ink-jet head 102. In this situation, the valve-accommodating chamber 132 functions as the ink supply passage. The flow of the ink (arrow in FIG. 19B) is formed, which is directed downwardly from the side of the ink chamber 131.

As shown in FIG. 14, the atmospheric air-introducing valve 122 is provided with the valve main body 145 and the valve plug 146 which is accommodated in the valve main body 145. The atmospheric air-introducing valve 122 is constructed in the same manner as the ink supply valve 121. That is, the atmospheric air-introducing valve 122 is constructed such that the valve plug 146, which is urged downwardly by the urging section 147, makes tight contact with the valve seat section 148 of the valve main body 145 so that the valve plug 146 closes the through-hole 148*a*. When the ink cartridge 103 is installed to the holder 104, the atmospheric air-introducing pipe 113 is inserted into the guide hole 149*a* formed in the valve main body 145. Similarly to the ink supply valve 121, the valve plug 146 is moved upwardly, and the thin film section 142 of the cylindrical section 141 is broken by the breaking section 152 of the valve plug 146. Accordingly, the outside atmospheric air flows from the atmospheric air-introducing pipe 113 via the communication passages 153 of the valve plug 146 into the valve-accommodating chamber 133. Further, the atmospheric air is introduced into the upper portion of the ink chamber 131 via the inner passage of the cylindrical member 143 and the cylindrical sections 140, 141.

The cap 124 is formed of the nontransparent material through which no light is transmitted unlike the cartridge main body 120. As shown in FIGS. 12 to 14, the cap 124 is secured to the cartridge main body 120, for example, by the ultrasonic welding in a state in which the lower end of the cartridge main body 120 is covered therewith. Two annular projections 165, which protrude downwardly, are formed respectively at the positions of the bottom of the cap 124 corresponding to the ink supply valve 121 and the atmospheric air-introducing valve 122 respectively. In this structure, for example, when the ink cartridge 103 is placed on a desk, the ink, which is adhered to those in the vicinity of the inlets of the ink supply valve 121 and the atmospheric air-introducing valve 122, is hardly adhered, for example, to the desk surface.

As shown in FIGS. 12 to 14, a rib 166, which extends in the vertical direction, is formed on the side wall portion of the cap 124 on the same side as that of the projection 134 formed on the outer wall of the cartridge main body 120. The rib 166 is formed under the projection 134. As shown in FIGS. 12B and 14, the rib 166 and the shield plate 160 in the projection 134 of the cartridge main body 120 are arranged at the positions separated from each other by a predetermined distance in the vertical direction. The rib 166 is positioned at the position lower than the shield plate 160. Therefore, the rib 166 is positioned at the position lower than the light-emitting section 114*a* and the light-receiving section 114*b* of the sensor 114 in a state in which the ink cartridge 103 is installed to the holder 104. Further, the rib 166 is located at the position interposed between the light-emitting section 114*a* and the light-receiving section 114*b* of the sensor 114 as viewed in a plan view in which the ink cartridge 103 is viewed in the direction of installation. The width of the rib 166 is narrower than the width of the projection 134, and the protruding distance of the rib 166 is shorter than the protruding distance of the projection 134.

The rib 166 is detected such that the rib 166 passes between the light-emitting section 114*a* and the light-receiving section 114*b* of the sensor 114 to instantaneously shut off the light from the light-emitting section 114*a* of the sensor 114 only when the ink cartridge 103 is installed to the holder 104 or when the ink cartridge 103 is detached from the holder 104. On the other hand, the rib 166 exists at the position lower than the sensor 114 in the state of installation of the ink cartridge 103. Therefore, the rib 166 is not detected by the sensor 114. Only the shield plate 160, which is arranged in the ink chamber 131, can be detected by the sensor 114. That is, the rib 166 can be detected by the sensor 114 only when the ink cartridge 103 is attached/detached. Therefore, it is possible to recognize whether or not the ink cartridge 103 is installed, by using the control unit 108 as described later on, on the basis of the result of detection of the rib 166. In the third embodiment, the structure is provided such that the rib 166 is detected by the sensor 114 only by attaching/detaching the ink cartridge 103 in a certain direction. Therefore, it is unnecessary to perform any complicated operation, which would be otherwise performed in order to detect the rib 166 with the sensor 114. Further, it is possible to extremely avoid the breakage of the rib 166, which would be otherwise caused, for example, by any contact with the holder 104, the rib 166 being exposed to the outside and being weak in view of the strength.

Next, the control unit 108 will be explained. The control unit 108 manages the control of various operations to be performed by the ink-jet printer 101 including, for example, the discharge of the ink from the nozzles 102*a* of the ink-jet head 102, the supply of the paper to the ink-jet head 102, and the discharge of the printing paper having been subjected to the printing by the ink-jet head 102. The control unit 108 includes, for example, CPU (Central Processing Unit) which serves as a computing processing unit, ROM (Read-Only Memory) in which programs to be executed by CPU and data to be used for the programs are stored, RAM (Random Access Memory) which temporarily stores data during the execution of the program, a nonvolatile memory such as rewritable EEPROM (Electrically Erasable Programmable Read-Only Memory), an input/output interface, and a bus. As shown in FIG. 11, the control unit 108 controls a variety of devices for constructing the ink-jet printer 101 including, for example, the ink-jet head 102, the motor of the transport mechanism 106 for driving the carriage 105, and the suction pump 170 of the purge unit 107, on the basis of various signals inputted from an external personal computer (PC) 182.

As shown in FIG. 11, the control unit 108 further includes an installation state-judging section 180 which judges the installation state of the ink cartridge 103 in the holder 104 on the basis of the output signal from the sensor 114, and an ink residual amount-calculating section 181 which calculates the residual amount of the ink contained in the ink chamber 131.

Figure 21:
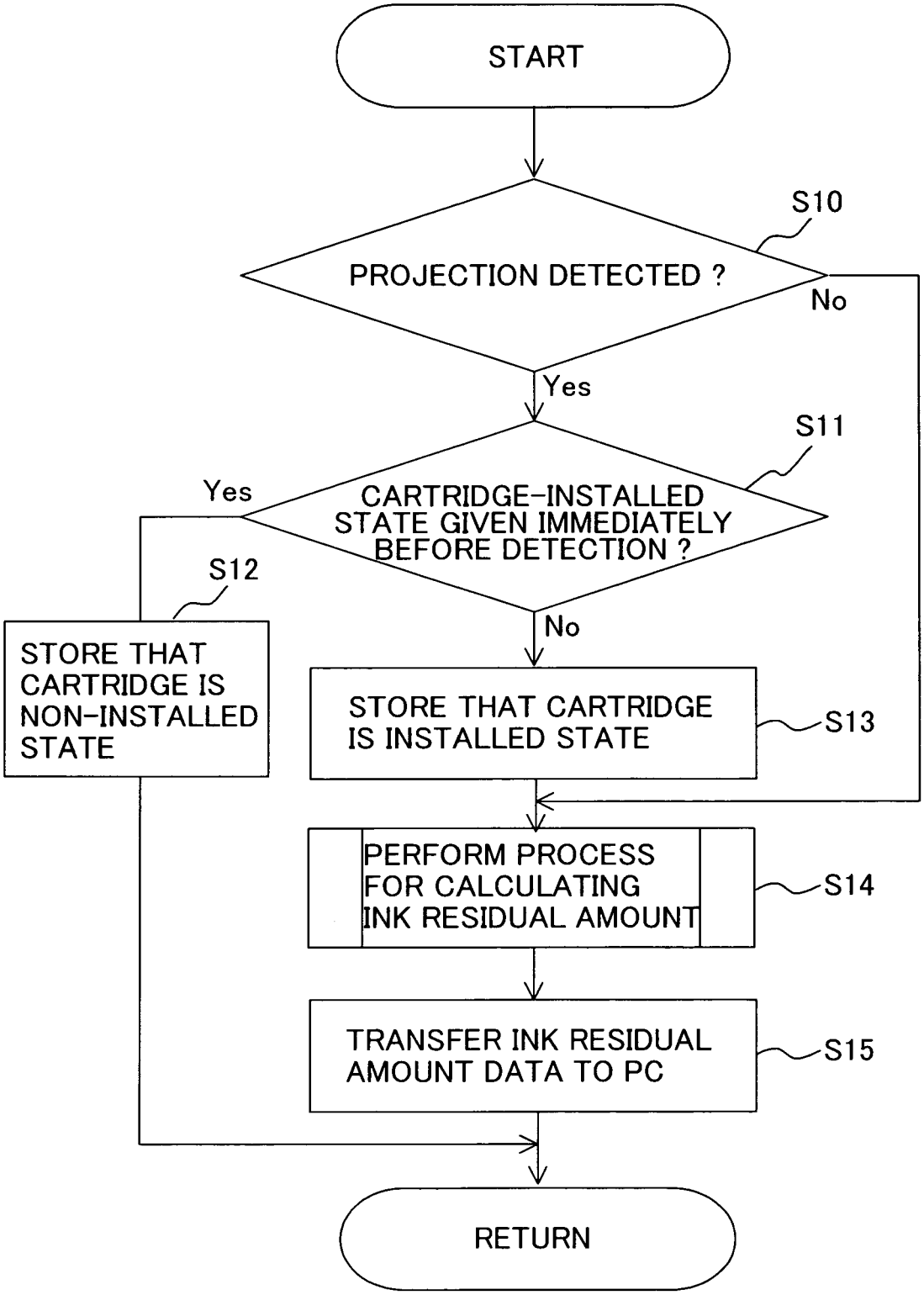
FIG. 21 shows a flow chart illustrating an installation state-judging process upon the attachment/detachment of the ink cartridge depicted in FIG. 11.

An explanation will be made below about the processing steps of the installation state-judging section 180 and the ink residual amount-calculating section 181 with reference to a flow chart for the installation state-judging process shown in FIG. 21. In FIG. 21, Si (i=10, 11, 12, . . . ) indicates each of the steps of the processing operation. This flow chart illustrates, by way of example, the processing steps to be applied when the ink cartridge 103*d* for storing the black ink is installed to the holder 104*d*.

At first, if it is judged that the rib 166 provided for the cap 124 is not detected by the sensor 114 in the judging process of S10 (in the case of "No" of the judgment result of S10) in a state in which the power source is applied to the ink-jet printer 101, the routine proceeds to the ink residual amount-calculating process of S14. On the other hand, if it is judged that the rib 166 is detected by the sensor 114 in the judging process of S10 (in the case of "Yes" of the judgment result of S10), the routine proceeds to the judging process of S11. In the judging process of S11, it is judged whether or not the cartridge has been installed immediately before the detection of the rib 166. If the ink cartridge 103*d* has been installed to the holder 104*d* immediately before the detection of the rib 166 (in the case of "Yes" of the judgment result of S11), then it is judged that the ink cartridge 103*d* has been detached from the holder 104*d*, and the information, which corresponds to the fact that the ink cartridge 103*d* is in the non-installed state, is stored (S12). In this case, it is unnecessary to calculate the ink residual amount. Therefore, the routine is subjected to the return as it is.

If the ink cartridge 103*d* has not been installed immediately before the detection of the rib 166 in the judging process of S11 (in the case of "No" of the judgment result of S11), the rib 166 of the ink cartridge 103*d* shown in FIG. 13 is consequently detected by installing the ink cartridge 103*d* to the holder 104*d*. Therefore, the information, which corresponds to the fact that the ink cartridge 103*d* is in the installed state, is stored (S13). After that, the routine proceeds to the ink residual amount-calculating process of S14.

In the ink residual amount-calculating process of S14, if the shield plate 160 of the shutter mechanism 123 is detected (if the ink residual amount is sufficient), the ink residual amount is approximately calculated from the maximum capacity of the ink cartridge 103*d* and the accumulated value of the number of liquid droplets of the ink having been discharged after the point of time of installation of the ink cartridge 103*d*. On the other hand, if the shield plate 160 of the shutter mechanism 123 is not detected (if the ink residual amount is decreased), the ink residual amount is calculated more correctly from the ink residual amount obtained in a state in which the shield plate 160 is not detected and the accumulated value of the number of liquid droplets of the ink having been discharged after the arrival at the state described above. The ink residual amount, which is calculated in S14, is transferred to PC 182 (S15), and the routine is subjected to the return.

The information, which includes, for example, the installation state of the ink cartridge 103 and the accumulated value of the discharged ink, is stored in the nonvolatile memory such as EEPROM in order that the information is retained even in a state in which the power source of the ink-jet printer 101 is turned OFF.

According to the third embodiment explained above, the distance between the shield plate 160 and the inner wall surface 134*b* of the recess 134*a* formed in the ink chamber 131 is maintained by the pins 159 which are formed on the side surfaces of the shield plate 160 of the swinging member. In this situation, the distance, which is in such an extent that no capillary phenomenon is caused by the surface tension of the ink, is secured between the shield plate 160 and the inner wall surface 134*b*. It is possible to avoid the adhesion between the shield plate 160 and the inner wall surface 134*b* by the surface tension of the ink and the deterioration of the smooth motion of the displacement of the shield plate 160. That is, the ink surface, which intervenes between the shield plate 160 and the inner wall surface 134*b*, can be similarly lowered as well, as the ink surface is lowered in accordance with the consumption of the ink. No ink, which prohibits the displacement of the shield plate 160 by the surface tension of the ink, remains between the shield plate 160 and the inner wall surface 134*b*. Therefore, in the third embodiment, the shield plate 160 can be smoothly operated in accordance with the change of the ink residual amount. Therefore, it is possible to detect, with any small error, the fact that the ink residual amount in the ink chamber 131 arrives at the predetermined amount.

The swinging member (displaceable member) is supported so that the rotation can be made to some extent in the plane parallel to the sheet surface of FIG. 16. Therefore, it is feared that the shield plate 160, which is provided at the position separated from the point of support by the support stand 163, may approach the inner wall surface 134*b* too closely depending on the spacing distance between the shield plate 160 and the inner wall surface 134*b*. In order to solve this problem, the operation of the shield plate 160 can be smoothened without being affected by the surface tension of the ink by widening the spacing distance between the shield plate 160 and the inner wall surface 134*b*. However, in this case, it is necessary that the spacing distance between the light-emitting section 114*a* and the light-receiving section 114*b* of the sensor 114 is widened as well, which is any unsatisfactory countermeasure in view of the sensitivity of the sensor 114. It is necessary to use an expensive sensor having higher sensitivity depending on the spacing distance between the light-emitting section 114*a* and the light-receiving section 114*b*. However, according to the third embodiment, the spacing distance between the shield plate 160 and the inner wall surface 134*b* is regulated to such an extent that the smooth motion of the shield plate 160 is not deteriorated by the surface tension of the ink, by the aid of the pins 159 which are formed on the side surfaces of the shield plate 160 of the swinging member. Therefore, it is possible to further shorten the distance between the shield plate 160 and the inner wall surface 134*b*. Simultaneously, it is also possible to narrow the width of the projection 134. Further, it is possible to further narrow the width of the projection 134, because the shield plate 160 is the thin plate-shaped member. Accordingly, the cheap light-transmissive type optical sensor having low sensitivity can be utilized as the sensor 114.

Additionally, according to the third embodiment, the ribs 158, which extend in the vertical direction of the inner wall surfaces 134*b*, are formed on the inner wall surfaces 134*b* of the recess 134*a* in the ink chamber 131. Therefore, the ink, which is pooled between the shield plate 160 and the inner wall surface 134*b*, is successfully allowed to fall downwardly along the ribs 158. Accordingly, it is possible to further avoid the adhesion between the shield plate 160 and the inner wall surfaces 134*b* by the surface tension of the ink.

Further, according to the third embodiment, the tips of the pins 159 formed on the side surfaces of the shield plate 160 of the swinging member are constructed by the curved surfaces. Therefore, the pins 159 make the point-to-point contact with the inner wall surfaces 134*b* of the recess 134*a* in the ink chamber 131. Therefore, even when any ink remains between the pins 159 and the inner wall surfaces 134*b*, it is possible to suppress the remaining amount minimally. That is, the pins 159 and the inner wall surfaces 134*b* are hardly adhered by the surface tension of the ink. As a result, it is possible to smoothly operate the shield plate 160 as the ink residual amount is changed. It is possible to detect, with any small error, the fact that the ink residual amount in the ink chamber 131 arrives at the predetermined amount.

According to the third embodiment, the abutment section 160*a*, which is formed at the upper portion of the shield plate 160, is the columnar member. Therefore, the abutment section 160*a* and the abutment objective surfaces 156 in the ink chamber 131 make the line-to-line contact. Accordingly, the contact area between the abutment section 160*a* and the abutment objective surfaces 156 is decreased. Therefore, the abutment section 160*a* and the abutment objective surfaces 156 are hardly adhered by the surface tension of the ink. Therefore, it is possible to smoothly operate the shield plate 160 in accordance with the change of the ink residual amount. It is possible to detect, with any small error, the fact that the ink residual amount in the ink chamber 131 arrives at the predetermined amount.

According to the third embodiment, the ink, which is pooled on the abutment objective surfaces 156 formed in the ink chamber 131, is sucked by the capillary force of the curved section formed at the boundary between the abutment objective surface 156 and the rib 157 formed over the abutment objective surface 156 and the perpendicular wall surface 169, and the ink falls downwardly along the rib 157. Therefore, the abutment section 160*a* and the abutment objective surface 156 are hardly adhered by the surface tension of the ink. Simultaneously, in a state in which the abutment section 160*a* abuts against the abutment objective surface 156, the tip of the abutment section 160*a* makes contact with the side surface of the rib 157. Therefore, the ink, which is retained between the abutment section 160*a* and the abutment objective surface 156, is also sucked by the capillary force of the curved section formed at the boundary between the abutment objective surface 156 and the rib 157. Therefore, the abutment section 160*a* can be easily separated from the abutment objective surface 156 at an appropriate timing depending on the lowering of the ink surface.

According to the third embodiment, as shown in FIG. 18, the structure is provided, in which the curvatures are decreased in the order of the curvature of the curved section (C in FIG. 18C) formed at the boundary between the rib 157 and the lower end area of the perpendicular wall surface 169, the curvature of the curved section (B in FIG. 18B) formed at the boundary between the rib 157 and the upper end area of the perpendicular wall surface 169, and the curvature of the curved section (A in FIG. 18A) formed at the boundary between the rib 157 and the abutment objective surface 156. Accordingly, the capillary forces of the curved sections formed at the boundaries between the rib 157 and the abutment objective surface 156 and the perpendicular wall surface 169 are increased at the lower portions of the rib 157 positioned downwardly. The action is effected to move the ink more downwardly as a whole. That is, the ink, which is pooled in the vicinity of the boundary between the abutment objective surface 156 and the rib 157, tends to fall downwardly along the rib 157 with ease.

Additionally, according to the third embodiment, the abutment objective surface 156 formed in the ink chamber 131 is the inclined surface. The ink, which is pooled on the abutment objective surface 156, falls and flows downwardly along the inclined surface. Therefore, the ink is more hardly pooled on the abutment objective surface 156.

Further, according to the third embodiment, the connecting member 162 having the shield plate 160 is rotated, and thus the shield plate 160 is displaced. Therefore, the shield plate 160 can be displaced stably along the predetermined orbit. Therefore, the shield plate 160 is hardly adhered to the inner wall surface 134*b* which is disposed outside the predetermined orbit.

Fourth Embodiment

Figure 22:
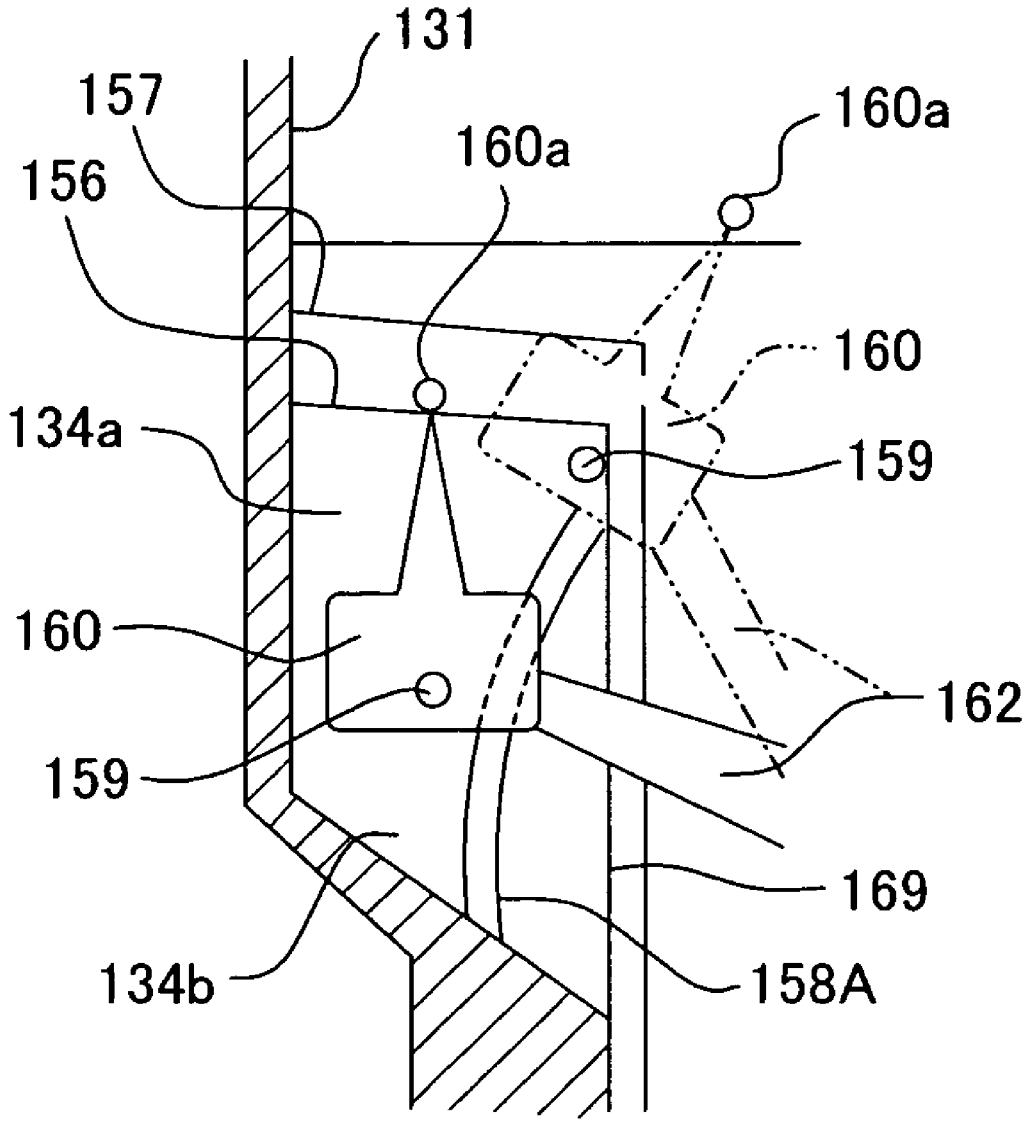
FIG. 22 shows a magnified view illustrating a partial cross section of an ink cartridge according to a fourth embodiment.

Next, a fourth embodiment will be explained with reference to the drawings. In the fourth embodiment, substantially the same members as those of the third embodiment are designated by the same reference numerals as those of the third embodiment, any explanation of which will be omitted. The abutment section 160*a*, which is provided at the upper end of the shield plate 160 (detection objective section), is displaced so that the shield plate 160 depicts the circular arc-shaped orbit, when the abutment section 160*a* is moved from the position (detecting position) at which the abutment section 160*a* abuts against the abutment objective surfaces 156 formed in the ink chamber 131 to the position (non-detecting position) at which the abutment section 160*a* is separated from the abutment objective surfaces 156. Accordingly, in the fourth embodiment, as shown in FIG. 22, ribs 158A, which continuously extend while being curved along the displacement track (circular arc-shaped orbit) of the shield plate 160 and which protrude toward the shield plate 160 arranged in the recess 134*a*, are formed on the respective inner wall surfaces 134*b* of the recess 134*a*.

According to the fourth embodiment explained above, the ink, which is pooled between the area of the displacement of the shield plate 160 and the inner wall surfaces 134*b* of the recess 134*a*, is successfully allowed to fall downwardly along the ribs 158A. Accordingly, it is possible to prevent the shield plate 160 and the inner wall surfaces 134*b* from being adhered by the surface tension of the ink. Therefore, it is possible to smoothly operate the shield plate 160 in accordance with the change of the ink residual amount. It is possible to detect, with any small error, the fact that the ink residual amount in the ink chamber 131 arrives at the predetermined amount.

Fifth Embodiment

Next, an explanation will be made about a fifth embodiment with reference to the drawings. In the fifth embodiment, substantially the same members as those of the third embodiment are designated by the same reference numerals as those of the third embodiment, any explanation of which will be omitted.

Figure 23:
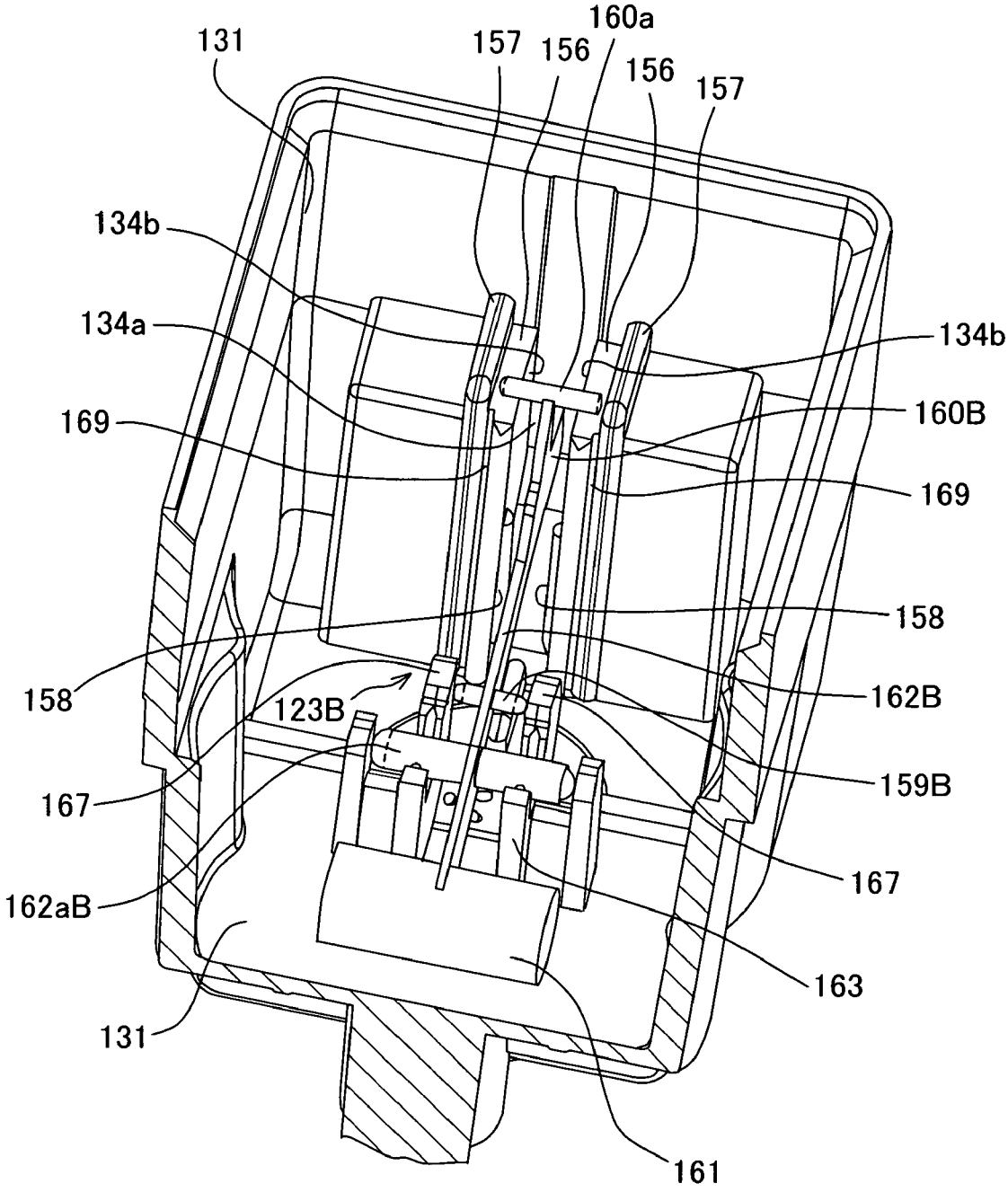
FIG. 23 shows a perspective view illustrating a partial cross section of an ink cartridge according to a fifth embodiment.

As shown in FIG. 23, a shutter mechanism 123B, which is provided in the lower side space of the ink chamber 131, includes a nontransparent shield plate 160B (detection objective section), a hollow float 161 (balance member), a connecting member 162B which connects the shield plate 160B and the float 161, a support stand 163 which is provided on the comparting wall 130 and which rotatably supports the connecting member 162B, and a pair of preventive walls 167 which prevent the connecting member 162B from any lateral fluctuation. In the fifth embodiment, the displaceable member (swinging member) is constructed by the shield plate 160B, the float 161, and the connecting member 162B. The float 161 is a cylindrical member having a tightly closed space filled with the air therein. The specific gravity of the entire float 161 is smaller than the specific gravity of the ink contained in the ink chamber 131. The shield plate 160B and the float 161 are provided at both ends of the connecting member 162B respectively. A columnar rotational shaft 162*a*B, which protrudes in the direction perpendicular to the side surfaces of the connecting member 162B, is formed in the vicinity of the center in the extending direction of the connecting member 162B. The connecting member 162B is rotatably supported on the support stand 163 about the axis of the rotational shaft 162*a*B. As shown in FIG. 23, the pair of preventive walls 167 are plate-shaped members which extend in the vertical direction from the bottom surface of the ink chamber 131. The pair of preventive walls 167 are provided between the rotational shaft 162*a* and the perpendicular wall surfaces 169 in the ink chamber 131. Further, the pair of preventive walls 167 are arranged at such positions that the connecting member 162B is interposed between the pair of preventive walls 167.

The shield plate 160B is a thin plate-shaped member which is parallel to the vertical surface (plane parallel to the sheet surface of FIG. 14) and which has a predetermined area. The shield plate 160B has a rectangular area and a triangular protruding area which is formed to further extend upwardly from the upper end of the rectangular area. An abutment section 160*a*, which has a columnar shape extending in the direction perpendicular to the side walls of the ribs 157 (direction along the ink surface), is formed at the upper end of the protruding area.

As shown in FIG. 23, columnar pins (projections) 159B, which protrude in the perpendicular directions toward the flat surfaces of the preventive walls 167, are formed respectively on the both side surfaces of the connecting member 162B interposed between the pair of preventive walls 167. The tips of the pins 159B are constructed by curved surfaces. In this structure, the tips of the pins 159B are always opposed to the inner side surfaces of the preventive walls 167 within a range in which the abutment section 160*a* of the shield plate 169B is moved between the position (detecting position) of abutment against the abutment objective surfaces 156 and the position (non-detecting position) of separation from the abutment objective surfaces 156.

According to the fifth embodiment explained above, the structure is provided, in which the pins 159B formed on the both side surfaces of the connecting member 162B are interposed by the pair of preventive walls 167. Accordingly, the distances between the shield plate 160B and the inner wall surfaces 134B are maintained. Therefore, it is possible to prevent the shield plate 160B and the inner wall surfaces 134*b* from being adhered by the surface tension of the ink. Therefore, it is possible to smoothly operate the shield plate 160B in accordance with the change of the ink residual amount. It is possible to detect, with any small error, the fact that the ink residual amount in the ink chamber 131 arrives at the predetermined amount. The pins 159B and the side surfaces of the preventive walls 167 opposed thereto are formed in the vicinity of the rotational shaft 162*a*B. Therefore, the displacement range of the pin 159B is decreased, and it is possible to realize the small size of the preventive wall 167 opposed to the pin 159B.

The embodiments of the present invention have been explained above. However, the present invention is not limited to the embodiments described above, for which the design may be variously changed within the scope defined in claims. For example, the first embodiment is constructed such that the regulating member 35 is provided to regulate the rotation of the lever 32 in the first direction. However, the present invention is not limited thereto, which may be constructed such that the regulating member 35 is not provided.

The first embodiment is constructed such that the shutter 34 is arranged at the detecting position when the lever 32 is rotated in the first direction, and the shutter 34 is arranged at the non-detecting position when the lever 32 is rotated in the second direction. However, the present invention is not limited thereto, and the following arrangement may be available. That is, the shutter 34 is arranged at the non-detecting position when the lever 32 is rotated in the first direction, and the shutter 34 is arranged at the detecting position when the lever 32 is rotated in the second direction.

The float 33 is formed of the polyacetal resin in the first embodiment, and the float 33A is formed of the polypropylene resin in the second embodiment. However, the present invention is not limited thereto. The float may be formed of another resin, or the float may be formed of a material other than the resin.

Additionally, in the first embodiment, the ratio K of the volume of the tightly closed space with respect to the total volume of the float 33 is determined so that the rotational force in the first direction of the lever 32 has the same magnitude as that of the rotational force in the second direction. However, the present invention is not limited thereto. The volume ratio K of the float 33 may be determined so that any one of the rotational force in the first direction and the rotational force in the second direction is larger than that of the other.

The first embodiment is constructed such that the shutter 34 is nontransparent. However, the present invention is not limited thereto. The shutter may be constructed to be light-transmissive. In this case, a sensor other than the light-transmissive type optical sensor used in the first embodiment may be used as the detector for the shutter 34.

In the first embodiment, the light-transmissive type optical sensor is used for the sensor 21. However, the present invention is not limited thereto. Another optical sensor such as a reflective type optical sensor may be used. Alternatively, a sensor other than the optical sensor may be used. When a reflective type optical sensor is used as the sensor 21, it is desirable that the shutter 34 is constructed so that the reflectance of the surface is raised.

Figure 24A:
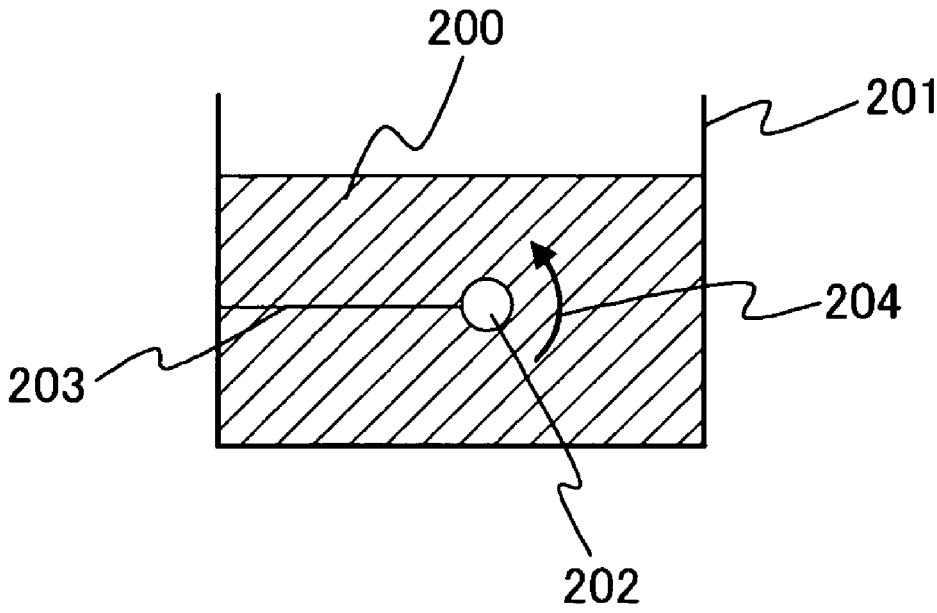
FIG. 24A shows a situation in which the ink is sufficiently charged.
Figure 24B:
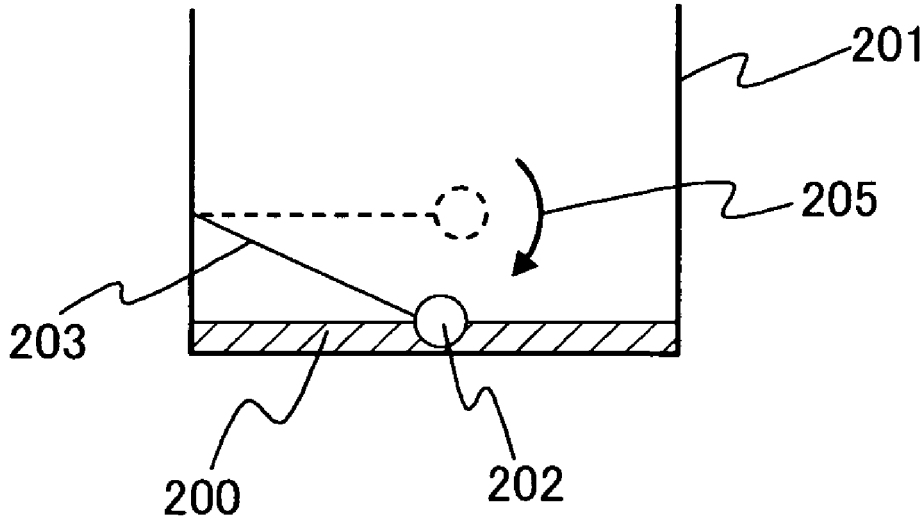
FIG. 24B shows a situation in which the ink is decreased.

Additionally, the first embodiment is constructed such that the sensor 21 detects not only the state of the ink residual amount in the ink tank 11 but also the presence or absence of the ink cartridge. However, the present invention is not limited thereto, and the following arrangement may be available. That is, the sensor 21 may detect only the state of the ink residual amount in the ink tank 11. The first embodiment is constructed such that the float 33 and the shutter 34 are provided at the ends of the lever 32, and the central portion of the lever 32 is supported by the support stand. However, there is no limitation thereto. As shown in FIG. 24, one end of the support member 203 may be a free end, the float 202 (balance member) may be attached to the one end, and the other end of the support member 203 may be fixed to the ink tank. In this case, a detection objective section may be provided on the float.

The first and second embodiments are constructed such that the light-transmissive ink is used. However, the present invention is not limited thereto. An ink, which is not light-transmissive, may be used. In this case, it is preferable that the ink is not pooled at the detecting position in a state in which the ink is consumed.

In the second embodiment, the curved section 32*a*A is formed on the surface of the lever 32A opposed to the ink liquid surface. However, the present invention is not limited thereto. The surface of the lever 32A opposed to the ink liquid surface may be formed to have an arbitrary shape provided that the contact area between the lever 32A and the ink liquid surface is decreased with this shape. For example, a projection, which is thin plate-shaped, may be formed on the wall surface opposed to the ink liquid surface.

The third embodiment is constructed such that the shield plate 160 is arranged to make the displacement between the pair of inner wall surfaces 134*b* of the recess 134*a* formed in the ink chamber 131. However, the present invention is not limited thereto. The arrangement may be made such that the shield plate 160 is displaced along one inner wall surface. In this case, the pin 159 may be provided on one side surface of the shield plate 169, and the pin 159 may be formed to protrude toward one opposing inner wall surface 134*b*.

The third embodiment is constructed such that the shield plate 160 is thin plate-shaped. However, the present invention is not limited thereto. The shield plate 160 may have another shape such as any spherical shape.

The third embodiment is constructed such that the ribs 158 are provided on the side surfaces of the inner wall surfaces 134*b* of the recess 134*a*, and the ribs 157 are provided on the vertical wall surfaces 169 and the abutment objective surfaces 156 in the ink chamber 131. However, the present invention is not limited thereto. An arrangement may be available, in which no rib as described above is provided.

In the third to fifth embodiments, the tips of the pins 159, 159B of the swinging member are constructed by the curved sections. However, the present invention is not limited thereto. Any tip shape may be available provided that the ink, which is in such an amount that the smoothness of the operation is deteriorated during the displacement of the swinging member, does not remain even if the ink remains between the pin 159 and the inner wall surface 134*b* and/or between the pin 159B and the side surface of the preventive wall 167. The tip shape of the pin 159, 159B may be either sharp or flat.

In the third embodiment, the abutment section 160*a*, which is provided at the upper end of the shield plate 160, is the columnar member. However, the present invention is not limited thereto. For example, the abutment section 160*a* may be plate-shaped. The third embodiment is constructed such that the abutment objective surface 156 in the ink chamber 131 is the inclined surface. However, the present invention is not limited thereto. The abutment objective surface 156 may be a horizontal surface.

The third embodiment is constructed such that the swinging member is rotated about the center of the rotational shaft 162*a* in accordance with the increase/decrease in the ink amount in the ink chamber 131. However, the present invention is not limited thereto. For example, the following arrangement is available. That is, the swinging member is composed of a shield plate and a float connected directly thereto, and the swinging member is displaced to follow the displacement of the ink liquid surface in accordance with the increase/decrease in the ink amount in the ink chamber.

In the fourth embodiment, the ribs 158A, which are formed on the inner wall surfaces 134*b* of the recess 134*a*, are formed along the displacement orbit of the shield plate 160. However, the present invention is not limited thereto. In order that the ink is not retained between the shield plate 160 and the inner wall surface 134*b* as far as possible and the swinging is successfully rotated more smoothly, the ribs 158A are preferably formed to extend along the displacement orbit of the pins 159 formed on the side surfaces of the shield plate 160.

In the third to fifth embodiments, it is possible to appropriately change, for example, the shapes, the heights, and the widths of the inner wall surfaces 134*b* formed in the ink chamber 131 and the ribs 157, 158, 158A formed on the abutment objective surfaces 156 and the perpendicular wall surfaces 169. In the third to fifth embodiment, the ribs 157 are formed over the range from the abutment objective surfaces 156 and the perpendicular wall surfaces 169, and the ribs 158 are formed to protrude from the inner wall surfaces 134*b* toward the shield plate 160. However, the present invention is not limited thereto. One of the ribs may be formed. In the third to fifth embodiments, the ribs 157, which are formed over the range from the abutment objective surfaces 156 and the perpendicular wall surfaces 169, have the angle of projection which is perpendicular to the abutment objective surfaces 156. However, the present invention is not limited thereto. The angle of projection may be either an obtuse angle or an acute angle. However, in order that the ink is hardly pooled at the boundary between the abutment objective surface 156 and the rib 157, the angle of projection is preferably an obtuse angle.

In the third to fifth embodiments, the rib 157 is provided continuously over the range from one end to the other end of the abutment objective surface 156. However, the present invention is not limited thereto. It is enough that the rib 157 may extend over the abutment objective surface 156 and the perpendicular wall surface 169. It is also allowable that the rib 157 extends up to an intermediate portion of the abutment objective surface 156. In this arrangement, in order that the ink is not retained between the abutment objective surface 156 and the abutment section 160*a* of the shield plate 160, it is preferable that the rib 157 extends on the abutment objective surface 156 to arrive at a position at which the side wall surface of the rib 157 makes contact with the tip of the abutment section 160*a* in a state in which the abutment section 160*a* of the shield plate 160 makes abutment against the abutment objective surface 156. Similarly, it is also allowable that the rib 157 does not extend to the lower end of the perpendicular wall surface 169.

In the third to fifth embodiments, as shown in FIGS. 18A to 18C, the relationship among the curvatures of the three curved sections formed at the boundaries between the rib 157 formed over the range from the abutment objective surface 156 and the perpendicular wall surface 169 and the abutment objective surface 156 and the perpendicular wall surface 169 resides in the relationship as explained with reference to FIGS. 18A to 18C (curvature of FIG. 18A<curvature of FIG. 18B<curvature of FIG. 18C). However, it is also allowable that the relationship as described above does not hold.

In the third to fifth embodiments, the curvatures of the curved sections formed at the boundaries between the rib 157 formed over the range from the abutment objective surface 156 and the perpendicular wall surface 169 and the abutment objective surface 156 and the perpendicular wall surface 169 are changed depending on the boundary position. Similarly, the curvature of the curved section formed at the boundary between the inner wall surface 134*b* and the rib 158 formed on the inner wall surface 134*b* of the recess 134*a* may be changed depending on the boundary position. Specifically, it is preferable that the curvature of the curved section formed at the boundary between the rib 158 and the portion in the vicinity of the upper end of the inner wall surface 134*b* is smaller than the curvature of the curved section formed at the boundary between the rib 158 and the portion in the vicinity of the lower end of the inner wall surface 134*b*. When the rib 158 is formed so that the relationship as described above holds, the capillary force of the curved section formed at the boundary between the rib 158 and the portion in the vicinity of the lower end of the inner wall surface 134*b* is larger than the capillary force of the curved section formed at the boundary between the rib 158 and the portion in the vicinity of the upper end of the inner wall surface 134*b*. Therefore, the ink, which remains at the boundary between the inner wall surface 134*b* and the rib 158, tends to fall downwardly along the rib 158.

In the third to fifth embodiments, the ribs 157, 158 are provided in relation to the recess 134*a*. However, the present invention is not limited thereto. The rib may be provided at any position irrelevant to the recess 134*a*.

In the third to fifth embodiments, the rotatable member, which is composed of the shield plate 160, the float 161, and the connecting member 162, is used as the swinging member. However, the present invention is not limited thereto. The swinging member may be a member like a simple float which is not rotatable. Even when the swinging member is used, it is also allowable that the shield plate 160 is not thin plate-shaped.

What is claimed is:

1. An ink cartridge, comprising:

an ink tank for storing ink;

a swinging member swingably supported in the ink tank, the swinging member comprising a float, a connecting member, and a light-blocking detection objective section, the float being provided at a first end of the connecting member and the detection objective section being provided at a second end of the connecting member, the connecting member being swingably supported in the ink tank at a position between the first end and the second end; and a regulating member for regulating the manner in which the swinging member swings, so that the float is positioned in the ink when an amount of ink contained in the ink tank is not less than a predetermined amount.

2. The ink cartridge according to claim 1, wherein when the swinging member is regulated by the regulating member, the detection objective section is positioned in a detecting position.

3. The ink cartridge according to claim 2, wherein when the detection objective section is positioned in the detecting position, the float is positioned in a position lower than the position of the detection objective section.

4. The ink cartridge according to claim 2, wherein when ink tank is empty of ink, the detection objective section is positioned in a non-detecting position.

5. An ink-jet printer, comprising:

the ink cartridge according to claim 2; and an installation section to which the ink cartridge is installed to perform recording on a medium with an ink supplied from the ink cartridge;

wherein:

the installation section comprises a detector; and the detector is provided in the installation section at a location that permits the detector to detect the detection objective section when the ink cartridge is installed in the installation section and the predetermined amount of ink is present in the ink tank.

6. The ink-jet printer according to claim 5, further comprising a judging unit that determines whether the ink cartridge and the ink-jet printer are in a first state or a second state based on data received from the detector, wherein:

the judging unit determines that the ink cartridge and the ink-jet printer are in the first state, in which the ink cartridge contains a sufficient amount of ink to perform recording, if the detector detects the detection objective section; and the judging unit determines that the ink cartridge is in the second state, in which the ink cartridge is not installed in the installation section or the ink cartridge does not contain a sufficient amount of ink to perform recording, if the detector does not detect the detection objective section.

7. The ink cartridge according to claim 1, wherein the float is heavier than the detection objective section.

8. The ink cartridge according to claim 1, wherein:

the connecting member has a length dimension extending from the float to the detection objective section, a height dimension extending from a surface closest to a bottom of the cartridge to a surface closest to a top of the cartridge, and a width dimension perpendicular to the length dimension and the height dimension; and each of the length dimension and the height dimension is greater than the width dimension.

9. The ink cartridge according to claim 8, wherein the connecting member is configured in the ink cartridge so that as an ink level in the ink cartridge rises or falls during operation, the bottom surface of the connecting member intersects obliquely with a surface of the ink when the bottom surface contacts the surface of the ink.

10. The ink cartridge according to claim 9, wherein the bottom surface of the connecting member comprises at least one projection that extends away from a remainder of the connecting member along the length dimension of the connecting member.

11. The ink cartridge according to claim 1, wherein:

the regulating member comprises a regulating surface for regulating displacement of the swinging member;

the ink tank comprises a first wall that extends at an angle with respect to a surface of the ink;

the swinging member is provided with an abutment section capable of movement between a position in abutment with the regulating surface and a position separated from the regulating surface, depending on a position of the swinging member; and the swinging member is provided with a projection that is positioned opposite from the first wall both when the abutment section contacts the regulating surface and when the abutment section is separated from the regulating surface.

12. The ink cartridge according to claim 11, wherein:

the ink tank comprises a recess bounded, at least in part, by the first wall and a second wall that that extends at an angle with respect to the surface of the ink;

at least a part of the swinging member is interposed between the first wall and the second wall; and the swinging member is further provided with a second projection that is positioned opposite from the second wall both when the abutment section contacts the regulating surface and when the abutment section is separated from the regulating surface.

13. The ink cartridge according to claim 12, wherein a first rib protrudes toward the swinging member from the first wall and a second rib protrudes toward the swinging member from the second wall.

14. The ink cartridge according to claim 1, wherein:

the regulating member comprises a regulating surface for regulating displacement of the swinging member and a wall surface that extends downwardly from one end of the regulating surface;

the swinging member is provided with an abutment section capable of movement between a position in abutment with the regulating surface and a position separated from the regulating surface, depending on a position of the swinging member; and the ink tank is provided with a rib that protrudes outwardly from and extends along the regulating surface and the wall surface.

15. The ink cartridge according to claim 1, wherein:

the float is formed of a resin; and the float has a specific gravity smaller than a specific gravity of the ink.

16. The ink cartridge according to claim 15, wherein the float is formed of polypropylene.

17. The ink cartridge according to claim 15, wherein the float comprises a closed space.

18. The ink cartridge according to claim 17, wherein:

the float comprises a case and a cap that are integrally formed; and the cap is arranged at an opening of the case so that the cap and the case enclose the closed space.

19. The ink cartridge according to claim 17, wherein a volume ratio K of the closed space with respect to a volume of the float is represented by the following expression:

$$(2X-Y)/2X-0.1<K<(2X-Y)/2X+0.1$$

wherein X represents the specific gravity of the resin, and Y represents the specific gravity of the ink.

20. The ink cartridge according to claim 17, wherein a volume ratio K of the closed space with respect to a volume of the float is not less than 0.3 and not more than 0.5.

21. An ink cartridge, comprising:

an ink tank for storing ink;

a swinging member swingably supported in the ink tank, the swinging member comprising a float, a connecting member, and a light-blocking detection objective section, the float being provided at a first end of the connecting member and the detection objective section being provided at a second end of the connecting member, the connecting member being swingably supported in the ink tank at a position between the first end and the second end; and a regulating member for regulating the manner in which the swinging member swings, so that the float is submerged in the ink when an amount of ink contained in the ink tank is not less than a predetermined amount.

22. The ink cartridge according to claim 21, wherein the float is heavier than the detection objective section.

23. The ink cartridge according to claim 21, wherein:

the connecting member has a length dimension extending from the float to the detection objective section, a height dimension extending from a surface closest to a bottom of the cartridge to a surface closest to a top of the cartridge, and a width dimension perpendicular to the length dimension and the height dimension; and each of the length dimension and the height dimension is greater than the width dimension.

24. The ink cartridge according to claim 23, wherein the connecting member is configured in the ink cartridge so that as an ink level in the ink cartridge rises or falls during operation, the bottom surface of the connecting member intersects obliquely with a surface of the ink when the bottom surface contacts the surface of the ink.

25. The ink cartridge according to claim 21, wherein:

the regulating member comprises a regulating surface for regulating displacement of the swinging member and a wall surface that extends downwardly from one end of the regulating surface;

the swinging member is provided with an abutment section capable of movement between a position in abutment with the regulating surface and a position separated from the regulating surface, depending on a position of the swinging member; and the ink tank is provided with a rib that protrudes outwardly from and extends along the regulating surface and the wall surface.

26. The ink cartridge according to claim 25, wherein:

the ink tank comprises a recess bounded, at least in part, by the first wall and a second wall that that extends at an angle with respect to the surface of the ink;

at least a part of the swinging member is interposed between the first wall and the second wall; and the swinging member is further provided with a second projection that is positioned opposite from the second wall both when the abutment section contacts the regulating surface and when the abutment section is separated from the regulating surface.

27. The ink cartridge according to claim 21, wherein the float comprises a closed space.

28. The ink cartridge according to claim 27, wherein:

the float comprises a case and a cap that are integrally formed; and the cap is arranged at an opening of the case so that the cap and the case enclose the closed space.

* * * * *